US008740217B2

(12) United States Patent
Thibault et al.

(10) Patent No.: US 8,740,217 B2
(45) Date of Patent: Jun. 3, 2014

(54) ROULETTE-TYPE GAME WITH MULTIPLE TRACKS

(75) Inventors: Harold Thibault, Montreal (CA); Felix Tremblay, Montreal (CA); Francis K Lalumiere, Brossard (CA); Suzie Dumont, Brossard (CA); Elise Dubois, Pincourt (CA); Marta Zalewska, Montreal (CA)

(73) Assignee: Ingenio, Filiale de Loto-Quebec Inc., Montreal, QC (CA)

( * ) Notice: Subject to any disclaimer, the term of this patent is extended or adjusted under 35 U.S.C. 154(b) by 0 days.

(21) Appl. No.: 13/002,597

(22) PCT Filed: Jul. 6, 2009

(86) PCT No.: PCT/CA2009/000895

§ 371 (c)(1),
(2), (4) Date: Jan. 4, 2011

(87) PCT Pub. No.: WO2010/000063

PCT Pub. Date: Jan. 7, 2010

(65) Prior Publication Data

US 2011/0109040 A1 May 12, 2011

Related U.S. Application Data

(60) Provisional application No. 61/078,374, filed on Jul. 4, 2008, provisional application No. 61/120,833, filed on Dec. 8, 2008.

(51) Int. Cl.
*A63B 71/00* (2006.01)

(52) U.S. Cl.
USPC ..... 273/142 E

(58) Field of Classification Search
USPC ..... 273/142 R
See application file for complete search history.

(56) References Cited

U.S. PATENT DOCUMENTS

| | | | | |
|---|---|---|---|---|
| 4,193,213 | A | 3/1980 | Suda | |
| 4,321,673 | A | 3/1982 | Hawwass et al. | |
| 4,467,424 | A * | 8/1984 | Hedges et al. | 463/26 |
| 4,531,187 | A * | 7/1985 | Uhland | 463/12 |
| 4,534,562 | A * | 8/1985 | Cuff et al. | 273/149 P |
| 5,306,007 | A | 4/1994 | Scuteri | |

(Continued)

FOREIGN PATENT DOCUMENTS

WO 2003018150 3/2003

OTHER PUBLICATIONS

The International Search Report of corresponding PCT/CA2009/000895.

(Continued)

*Primary Examiner* — Kurt Fernstrom
*Assistant Examiner* — Dolores Collins
(74) *Attorney, Agent, or Firm* — Anglehart et al.

(57) ABSTRACT

The play of roulette-type game is made more enticing by offering for a single bet a range of payouts from very modest with a high frequency to very great with low frequency. This is achieved without changing the underlying roulette-type game. In a twelve-position roulette, six balls can be used to provide over a 30% chance of getting a match, while the very low probability of getting 3 or more matches provides for generous payouts. Bets can also be placed on patterns of positions of balls.

76 Claims, 31 Drawing Sheets

(56) References Cited

U.S. PATENT DOCUMENTS

| | | | | |
|---|---|---|---|---|
| 5,636,838 | A | 6/1997 | Caro | |
| 5,728,002 | A * | 3/1998 | Hobert | 463/17 |
| 5,934,999 | A | 8/1999 | Valdez | |
| 6,059,659 | A * | 5/2000 | Busch et al. | 463/17 |
| 6,089,978 | A * | 7/2000 | Adams | 463/20 |
| 6,663,106 | B1 | 12/2003 | Cosmi | |
| 6,837,788 | B2 * | 1/2005 | Cannon | 463/16 |
| 6,890,255 | B2 | 5/2005 | Jarvis et al. | |
| 6,921,072 | B2 | 7/2005 | Hughes-Watts | |
| 7,390,529 | B2 | 6/2008 | Li et al. | |
| 7,455,587 | B2 * | 11/2008 | Olive et al. | 463/16 |
| 7,798,897 | B2 * | 9/2010 | Okada | 463/20 |
| 7,841,933 | B2 * | 11/2010 | Maul | 463/16 |
| 7,963,847 | B2 * | 6/2011 | Baerlocher | 463/27 |
| 8,021,230 | B2 * | 9/2011 | Baerlocher et al. | 463/25 |
| 8,216,065 | B2 * | 7/2012 | Kaminkow et al. | 463/30 |
| 8,251,801 | B2 * | 8/2012 | Wadds et al. | 463/25 |
| 2001/0005690 | A1 | 6/2001 | Boulton | |
| 2005/0236767 | A1 | 10/2005 | Parsadaian | |
| 2005/0255904 | A1 | 11/2005 | Duhamel | |
| 2006/0082057 | A1 | 4/2006 | Luciano | |
| 2006/0178191 | A1 | 8/2006 | Ellis | |
| 2008/0045310 | A1 | 2/2008 | Okada | |
| 2008/0132316 | A1 | 6/2008 | Fisher | |
| 2009/0253503 | A1 * | 10/2009 | Krise et al. | 463/31 |

OTHER PUBLICATIONS

Examination report of Australian application 2009266376 dated Feb. 14, 2014 with related claims 1-76.

* cited by examiner

ROULETTE-TYPE GAME WITH MULTIPLE TRACKS

FIELD OF THE INVENTION

The present invention relates to devices and methods for playing a game of chance. More specifically, it relates to devices and methods for playing a Roulette-type game with multiple tracks, wherein balls propelled within their respective tracks may yield one or more winning outcomes.

BACKGROUND OF THE INVENTION

Gambling has historically been a favourite pastime for many and has, over the years, enjoyed very rapid growth. More specifically, the game of Roulette has been known to be popular among casino patrons; it consists in placing wagers on the likelihood of a metal ball, having been propelled around a track in a rotary direction opposite that of a central wheel having indentations where the ball can come to rest, landing in one or another of the available final positions.

However, it has become apparent that Roulette has recently been slipping in popularity. It is now the least popular gambling games among slot machines, Video Poker, Blackjack, or Craps, each of which is a major casino game. Roulette draws more players than Baccarat only. Moreover, new games are continuously introduced, some of which are likely to challenge the popularity of conventional Roulette.

There is therefore a need for a generation of games which, while benefiting from the fundamental concept of conventional Roulette, proposes a variety of features that appeal to casino patrons for the purposes of competing with new games.

SUMMARY OF THE INVENTION

It would be desirable to be provided with an apparatus and a method for playing a Roulette-type game in which the odds that a wager placed on a single symbol results in a payout are greater than 25%.

It would also be desirable to be provided with an apparatus for identifying in real-time the station from which each wager is placed in the context of a multi-player game in which wagers can be placed from any of a plurality of stations at any time over the course of a same wager phase.

It would also be desirable to be provided with an apparatus for presenting wager options of a Roulette-type game in a manner that clearly indicates the position of groups of symbols on the wheel, and for placing wagers on groups of symbols in an intuitive manner.

It would also be desirable to be provided with a Roulette-type game in which wagers can be placed on patterns formed by randomly selected positions on the wheel.

It would also be desirable to be provided with an apparatus for displaying groups of winning wager options in a successive manner to promote an understanding of available wager options and associated odds among players.

In accordance with the present invention, the play of roulette-type games is made more enticing by offering for a single bet a range of payouts from very modest with a high frequency to very great with low frequency. This is achieved without changing the underlying game of roulette-type game. For example, in a twelve-position roulette, six balls can be used to provide over a 30% chance of getting a match, while the very low probability of getting 3 or more matches provides for generous payouts. Bets can also be placed on patterns of positions of balls.

In accordance with the present invention, there is provided an apparatus for playing a game of chance, the apparatus comprising a station for receiving a wager on a desired one of a plurality of potential outcomes in the game of chance, a game controller for randomly selecting one of the plurality of outcomes in accordance with rules of the game of chance, and a win controller for comparing the desired outcome to the randomly selected outcome, and for providing a win signal if the desired outcome is the randomly selected outcome, the apparatus characterized in that the apparatus is configured to repeatedly cause the game controller to play the game with the win controller using the desired outcome for a predetermined number of plays of the game, and in that the apparatus further comprises a multiple game win collector for counting a total number of the win signals provided during the predetermined number of plays of the game by the game controller, a multiple game play payout controller for calculating a payout greater than 0 credits if the number of win signals counted during the predetermined number of plays is greater than 0, for calculating the payout as a function of the number of win signals and the wager, and for providing the calculated payout, wherein the odds of the win controller providing at least one of the win signals during the predetermined number of plays is equal or greater than 25%.

In accordance with one embodiment of the invention, there is provided a method of playing a game of chance comprising receiving a wager of a player on a desired one of a plurality of potential outcomes in the game, randomly selecting a predetermined number of the potential outcomes in accordance with rules of the game, comparing the desired outcome and the randomly selected outcomes, and calculating a payout as a function of the wager and results of the comparing, the payout being greater than 0 credits if the desired outcome is one of the randomly selected outcomes, wherein the odds that the desired outcome is at least one of the randomly selected outcomes is equal or greater than 25%.

In accordance with one embodiment of the invention, there is provided an apparatus for playing a game of chance comprising a station for receiving a wager on some desired ones of a plurality of potential patterns of at least three positions, a game controller for randomly selecting at least three of a plurality of potential positions, and a payout controller for providing a payout as a function of the wager if any combination of the randomly selected positions matches any one of the desired patterns.

In accordance with one embodiment of the invention, there is provided a method of playing a game of chance comprising selecting some desired ones of a plurality of potential patterns of at least three positions, placing a wager on the desired patterns, randomly selecting at least three of a plurality of potential positions, and providing a payout as a function of the wager if any combination of the randomly selected positions matches any one of the desired patterns.

In accordance with one embodiment of the invention, there is provided an apparatus for playing a game of chance comprising a station for receiving a first wager on a desired one of a plurality of potential positions, and for receiving a second wager on a desired one of a plurality of potential patterns of at least three positions, a game controller for randomly selecting at least three of the plurality of potential positions, a payout controller for providing a payout as a function of the first wager if the desired position is one of the randomly selected positions, and for providing a payout as a function of the second wager if any combination of the randomly selected positions matches the desired pattern.

In accordance with one embodiment of the invention, there is provided an apparatus for placing wagers on potential outcomes of a game of chance, the apparatus comprising a station for receiving a first wager on a desired one of the potential outcomes, and for receiving a second wager on a desired group of at least two of the potential outcomes, a first interface controller for causing a display of the potential outcomes along a first closed shape, and for causing a display of a visual indicator of the first wager over the desired outcome, and a second interface controller for causing a display of groups of at least two of the potential outcomes along a second closed shape, and for displaying a visual indicator of the second wager over the desired group, wherein those of the displayed outcomes belonging to a same one of the displayed groups are contiguous, and each of the displayed outcomes is aligned with those of the displayed groups to which it belongs.

In accordance with one embodiment of the invention, in a multiplayer game of chance in which players can place their wagers at any time over the course of a wager phase, an apparatus for identifying in real-time, and to the players, one of two stations from which each of the wagers is placed, the apparatus comprising a first one of the stations for receiving some of the player wagers, and for providing a wager signal to a wager sequencer upon receiving each one of the first station player wagers, wherein the first station wager signals comprise the identity of the first station, a second one of the stations for receiving some of the player wagers, and for providing a wager signal to the wager sequencer upon receiving each one of the second station player wagers, wherein the second station wager signals comprise the identity of the second station, the wager sequencer for providing the first and the second station wager signals to an interface controller in the order in which they were provided by the first and the second station, and the interface controller for causing a display of a visual indicator of one of the first and the second station that received each of the wagers upon being provided each of the first and the second station wager signals.

In accordance with one embodiment of the invention, there is provided, in a game of chance that offers a plurality of wager options, an apparatus for displaying winning ones of the options after an outcome of the game has been determined, the apparatus comprising a winning wager options controller for identifying those of the options that are met by the determined outcome, namely the winning options, a winning wager options sequencer for dividing the winning options into at least two groups of winning options, and for providing each of the groups to an interface controller individually and at predetermined intervals of time, and the interface controller for causing an individual display of a most recently provided one of the groups.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE INVENTION

The Roulette-based game and its inventive features are described herein below. For exemplary purposes, and more specifically, in order to clearly demonstrate the synergy between the aforementioned features, an astrology-themed version of the game is presented. However, it should be apparent to a person skilled in the art that other themes may be assigned to the game.

Figure 1:
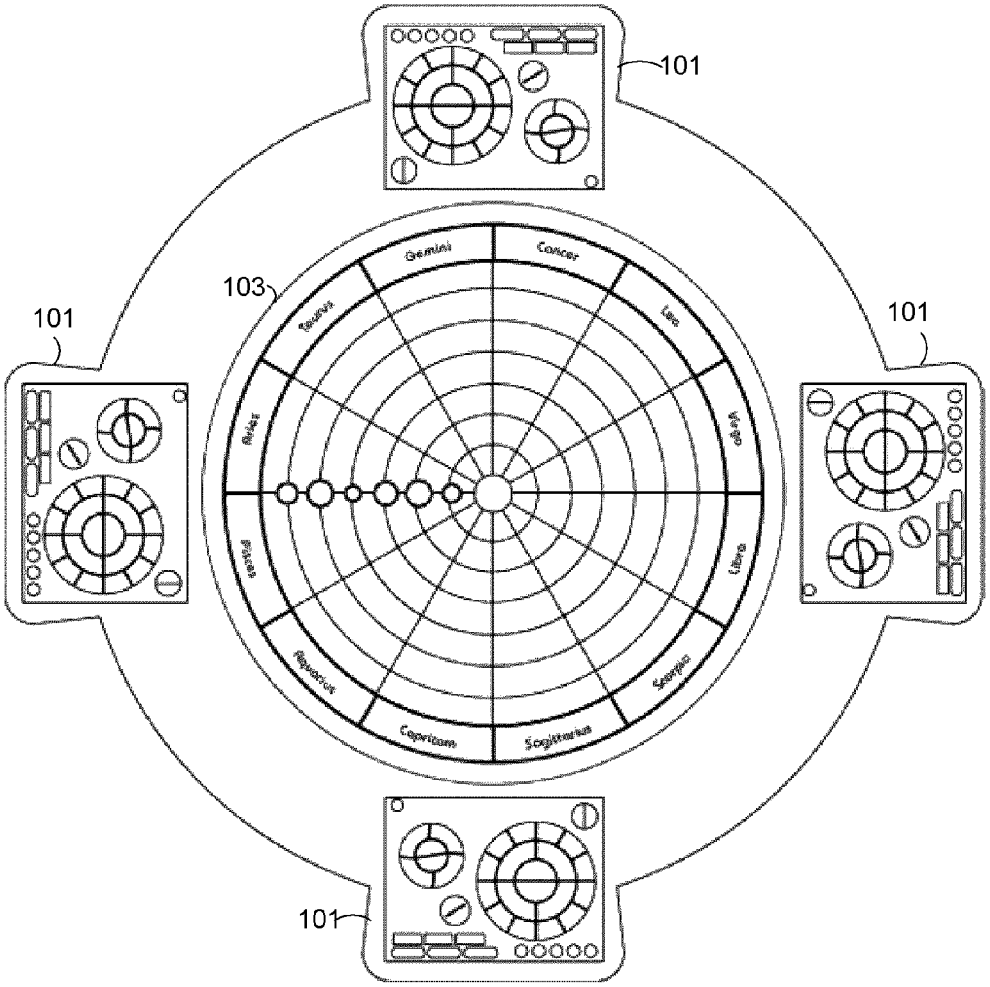
FIG. 1 is a plan view of an apparatus for playing a Roulette-based game comprising a communal panel for displaying game events and four individual stations for placing wagers on potential game outcomes.

FIG. 1 is a plan view of an apparatus for playing the game comprising a communal panel 103 for displaying results of a draw and four individual stations 101 for placing wagers on potential game outcomes.

The stations 101 are detachably mounted on a same platform and positioned in a substantially circular configuration with respect to the panel 103. Each of the individual stations 101 comprises a touch screen, a set of speakers, a currency acceptor, a dedicated printer, as well as a system that enables the interaction of these various components with a player, with each other, and with components of the panel 103 for the purposes of the game. As for the panel 103, it comprises a screen, a set of speakers, as well as a system that enables the interaction of these various components with each other and with components of the stations 101. Furthermore, the screens of the stations 101 and the panel 103 are mounted in a substantially horizontal manner and those of the stations 101 are positioned in proximity of that of the panel 103 such that a player's attention may easily be shifted between the screens of the station 101 and the panel 103. The number of the stations 101 mounted on the platform may be readily modified as a function of parameters such as spatial constraints and operation costs.

Although the stations 101 have been described as detachably mounted on the platform, they may be fixedly mounted thereon in order, for instance, to reduce costs associated with the manufacture of such an apparatus. Furthermore, although the stations 101 have been described as positioned in a substantially circular configuration with respect to the panel 103, they may be positioned otherwise such as in a substantially semicircular configuration with respect to the panel 103 in order, for instance, to provide all players with an unobstructed view of a vertically mounted panel 103. Moreover, although each of the stations 101 has been described as comprising a touch screen, it may alternatively comprise an elaborate set of buttons or a screen coupled with a set of buttons. Also, although the panel 103 has been described as comprising a screen, it may alternatively comprise a display surface upon which images are projected. Finally, although the screens pertaining to the stations 101 and panel 103 have been described as mounted in a substantially horizontal manner, they may be mounted otherwise such as in a substantially vertical manner in order, for instance, to comply with spatial constraints.

For the purposes of the specification, a graphical element is said to be displayed on the station 101 or panel 103 if the element is displayed on the screen thereof. Also, a graphical element is said to be selected if a player applies pressure on a portion of the station 101 touch screen on which the element is displayed.

Figure 27:
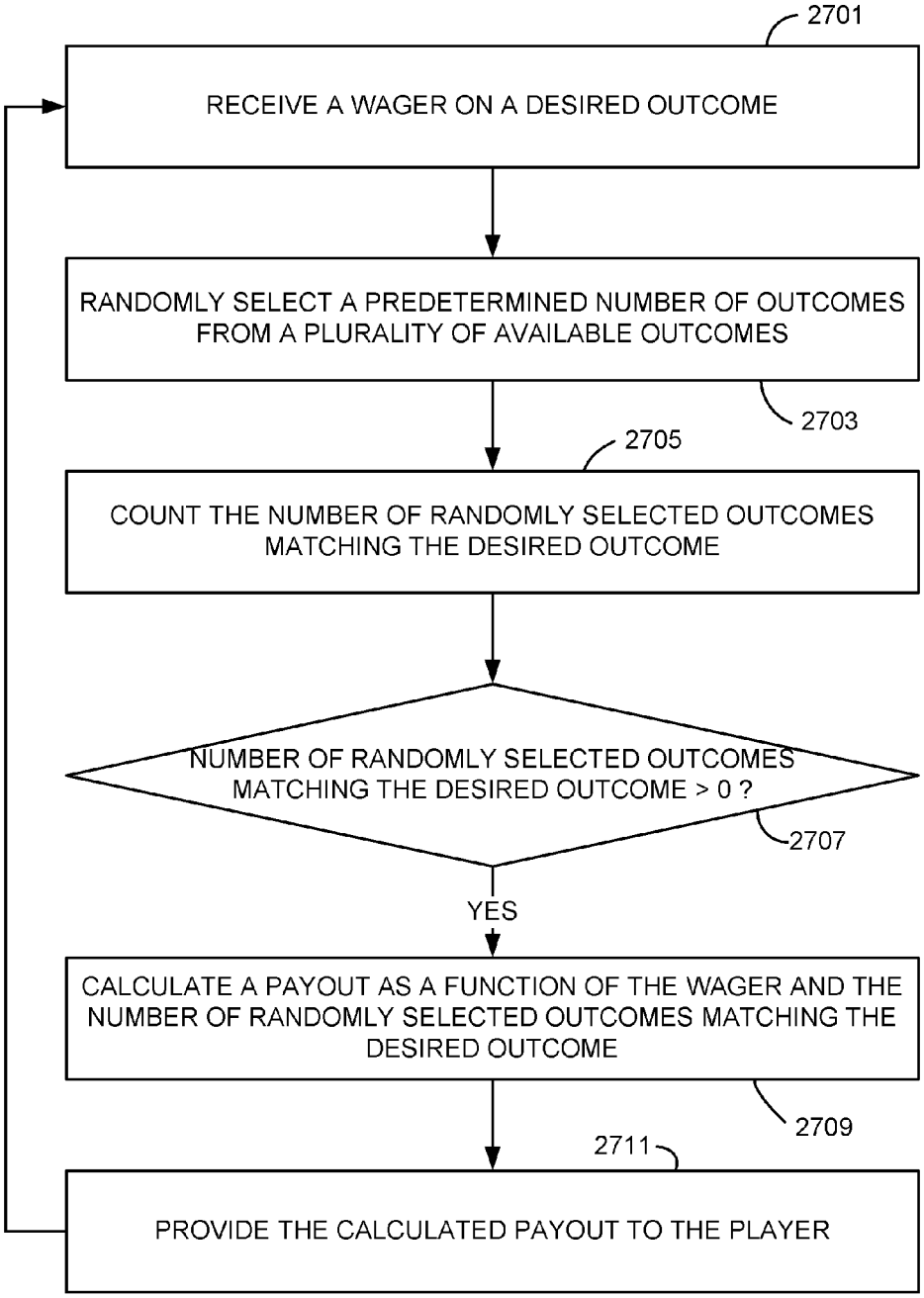
FIG. 27 is a flowchart of a method of playing a game of chance according to some embodiments of the invention.

FIG. 27 is a flowchart of a method of playing the game according to some embodiments of the invention. A first step 2701 of the method consists in receiving a wager on a desired outcome. Within the context of the specific embodiment described, a wager on a desired group of outcomes can also be received. Still within the context of the specific embodiment described, the desired outcome corresponds to one of twelve constant reference points, each of which is assigned a specific Zodiac Sign. The desired group of outcomes corresponds to a group of several constant reference points, and corresponding Zodiac Signs are affiliated to a same Season, a same Natural Element, a same one of Day and Night, or a same Gender.

Figure 26:
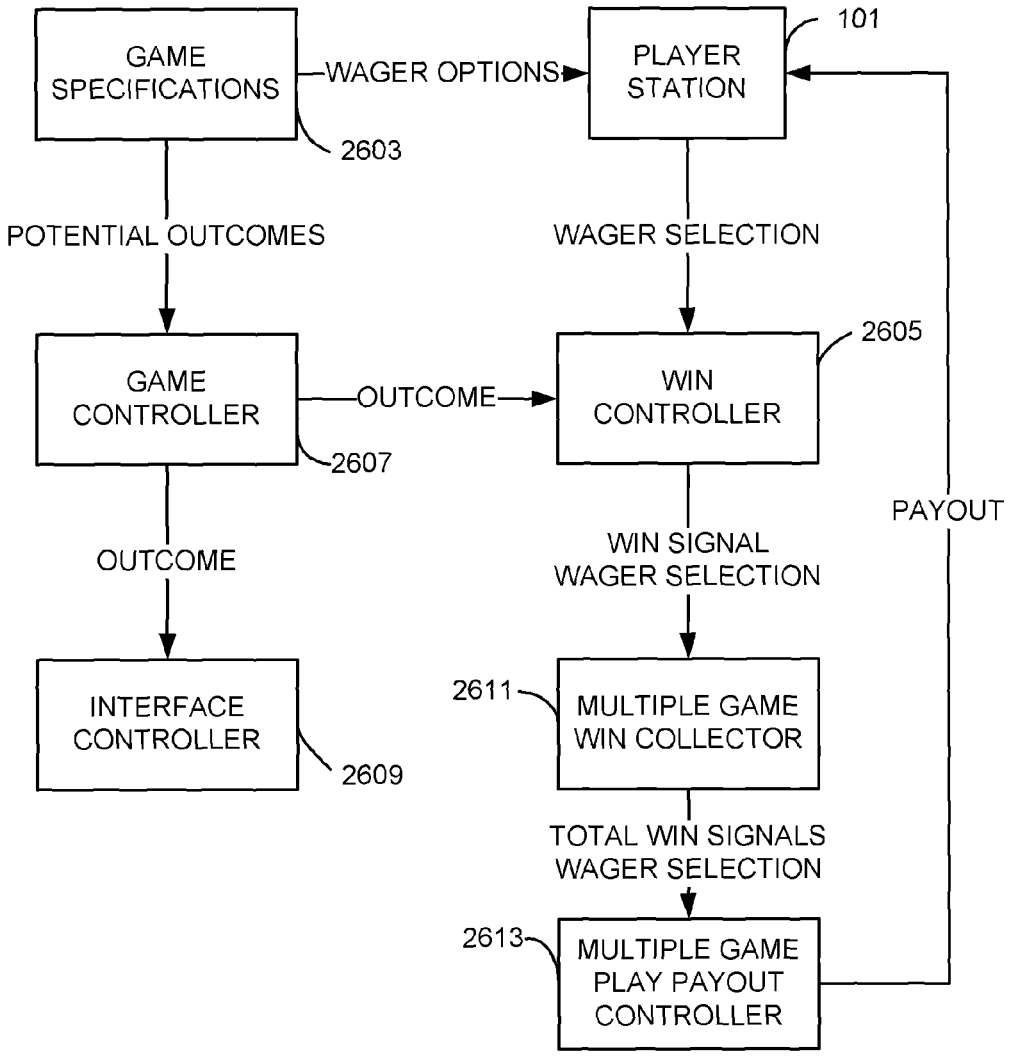
FIG. 26 is a schematic block diagram of a generic game apparatus according to some embodiments of the invention.

FIG. 26 is a schematic block diagram of a generic game apparatus according to an embodiment of the invention. A game specifications store 2603 provides wager options to a player station 101, which in turn presents wager options to a player and receives wagers placed by the player on a desired outcome or group of outcomes.

One of the main purposes of the station 101 consists in providing a user interface that enables players to place wagers on a series of potential outcomes of the game in an efficient and intuitive manner during the initial phase. The first step in placing a wager consists in selecting a category of constant reference points, namely a desired outcome or group of outcomes, under which several winning outcomes are possible. As mentioned previously, within the context of the astrology-themed version of the game, each of the twelve constant reference points is assigned one of the twelve Zodiac Signs, which are categorized according to their affiliation with Natural Elements, Day, Night, Seasons, and Gender. A potential outcome or group of potential outcomes pertaining to a specific category of Zodiac Signs consists in a Planet which, following its revolutions around the Sun, is aligned with and positioned between the Sun and a member of the category.

Figure 28:
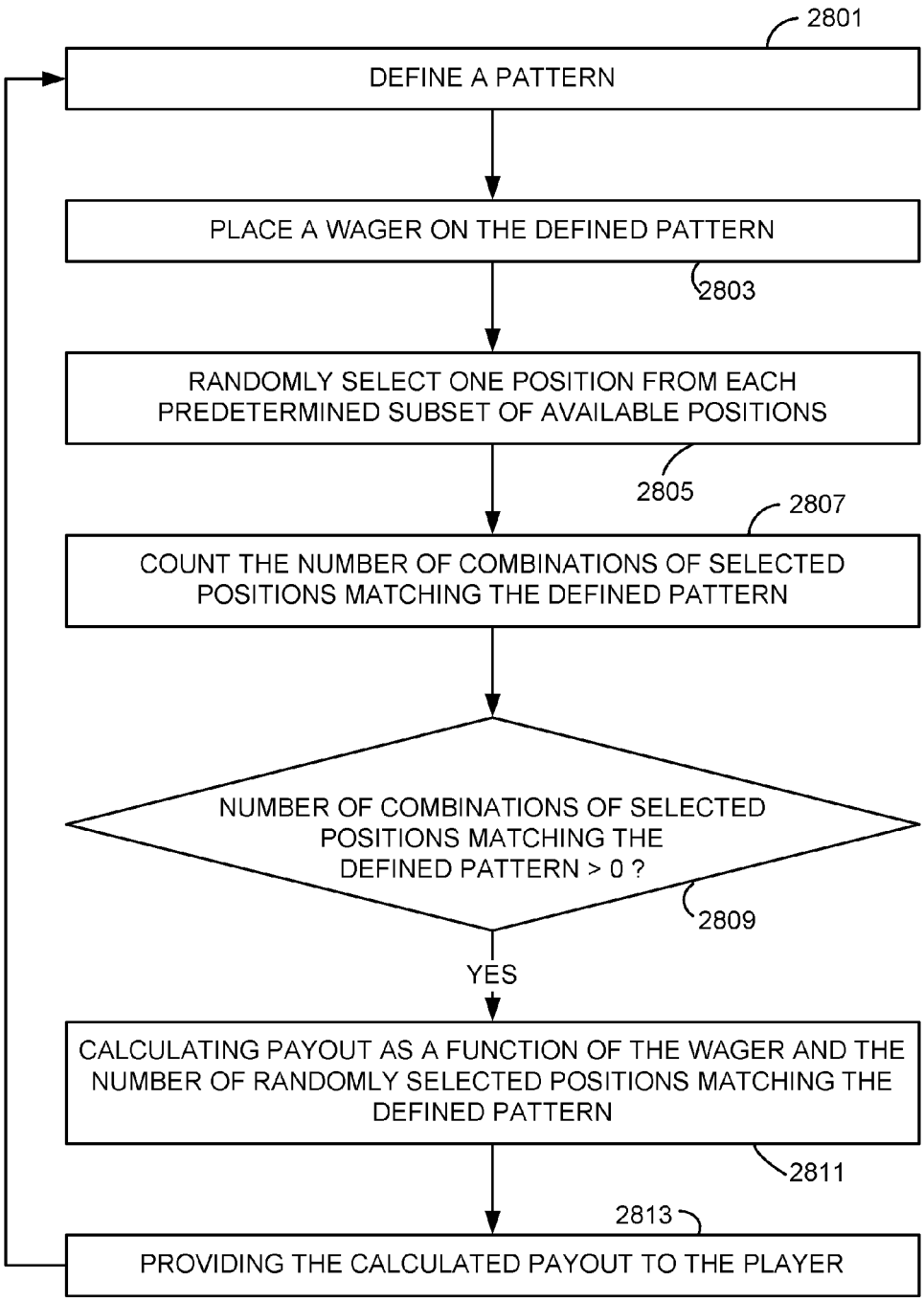
FIG. 28 is a flowchart of a method of playing a game of chance in which players can place wagers on patterns formed by positions randomly selected within a plurality of available positions.

According to a preferred embodiment of the game, in addition to designating a particular Zodiac Sign, each of the potential outcomes designates one of a plurality of positions, and the random selection of an outcome results in the random selection of a position. Still according to the preferred embodiment, the station 101 can receive wagers on patterns formed by positions randomly selected over the course of several successive plays of the game. A flowchart of the method of playing the game according to this particular wager option is illustrated in FIG. 28. A first step 2801 consists in defining a pattern within a position matrix integrated into the station 101, and placing a wager on the defined pattern in a step 2803.

Although within the specific embodiment described, the methods of playing a game of chance presented in FIG. 27 and FIG. 28 are integrated within a single game, each of the methods may very well relate to an independent game. Also, while the step 2801 consists in defining a pattern, it may alternatively consist in selecting one of a plurality of predetermined patterns. Within the specific embodiment described, each of six variable reference points is assigned one of six Planets, and wagers can be received on patterns formed by the Planets after their revolutions around the Sun. One of the patterns, namely the Alignment pattern, consists in an alignment of a number of Planets with each other and with the Sun. It is important to note that in the latter case, namely the case of an Alignment, aligned Planets do not necessarily have to be positioned between the Sun and a same Zodiac sign with which they are aligned; in other words, if the Sun pertains to a line segment defined by two Planets, the Sun and the Planets are considered to be aligned. The Planets and their revolutions around the Sun within the context of the game are explained in further details herein below as they mainly relate to the second phase of the game.

In accordance with the present invention, by reducing the number of constant reference points or potential outcomes with respect to traditional Roulette games, the complexity of the game is decreased, which is particularly advantageous as it increases the speed with which new players learn the rules of the game and the ease with which established players follow the course of a game.

For the purposes of the specification, Planets are said to be aligned with a Zodiac Sign if they are located between and aligned with the Sun and the Zodiac Sign. Also, two or more Planets are said to be aligned if the Planets and the Sun are aligned. The twelve Zodiac Signs include Capricorn, Aquarius, Pisces, Aries, Taurus, Gemini, Cancer, Leo, Virgo, Libra, Scorpio, and Sagittarius. Among those twelve Signs, Capricorn, Taurus, and Virgo are affiliated with Earth; Aquarius, Gemini, and Libra are affiliated with Air; Pisces, Cancer, and Scorpio are affiliated with Water; and Aries, Leo and Sagittarius are affiliated with Fire. Furthermore, still among those twelve Signs, Aries, Taurus, Gemini, Cancer, Leo, and Virgo are affiliated with Day whereas Libra, Scorpio, Sagittarius, Capricorn, Aquarius, and Gemini are affiliated with Night. Moreover, Capricorn, Aquarius, and Pisces are affiliated with Winter; Aries, Taurus, and Gemini, with Spring; Cancer, Leo, and Virgo, with Summer; and Libra, Scorpio, and Sagittarius, with Fall. Finally, Capricorn, Pisces, Taurus, Cancer, Virgo, and Scorpio are affiliated with Female whereas Aquarius, Aries, Gemini, Leo, Libra, and Virgo are affiliated with Male.

According to one embodiment of the present invention, alignments of one, two, three, four, five, and six Planets with a specific Sign yields payout factors of 1, 5, 10, 100, 2500 and 15000 respectively. Furthermore, alignments of one, two, three, four, five, and six Planets with Signs affiliated with a specific Season or Natural Element yield payout factors of 0, 1, 2, 5, 25, and 250. Also, alignments of one, two, three, four, five, and six Planets with Signs affiliated with either one of Day, Night, Male, or Female yield payout factors of 0, 0, 0, 1, 5, and 12. Finally, alignments of one, two, three, four, five, and six Planets yield payout factors of 0, 0, 0, 50, 150, and 1500. It is important to note that other payout factors may be attributed to the aforementioned alignments according to the needs of the game's operator. Furthermore, according to another embodiment of the present invention, wagers may be placed on specific outcomes consisting of a specific number of Planets aligned with a specific Sign or set of Signs.

Figure 2:
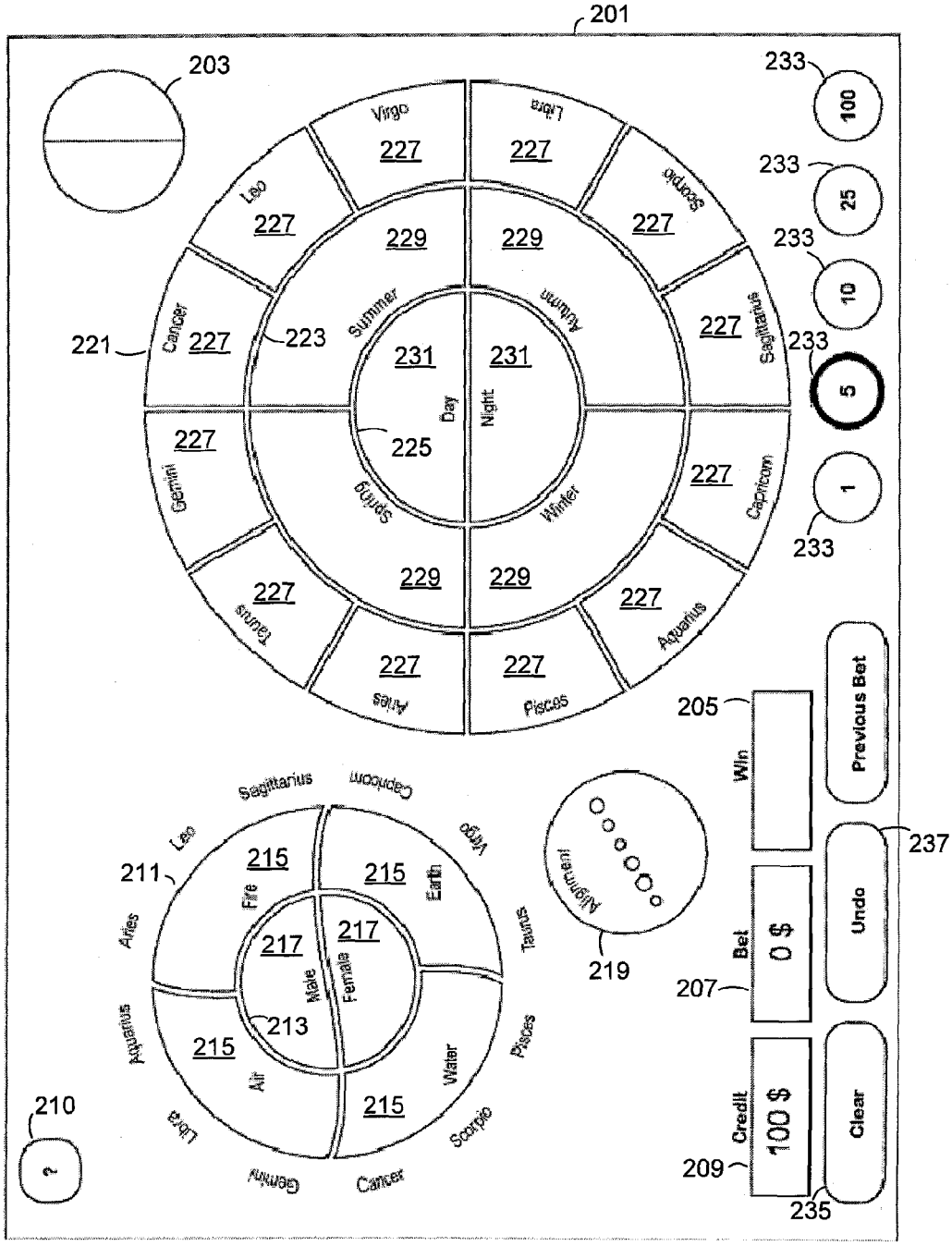
FIG. 2 illustrates a user interface window to be displayed on a screen of a station for selecting a desired category of reference points during a first phase of the game.

FIG. 2 illustrates a user interface window 201 to be displayed on a station 101 for selecting one of the aforementioned categories of Signs.

In the window 201, a language selection tool can be displayed, the tool enabling a player to select at any time during the course of a game a language of preference in which information is to be displayed. In this particular case, the player may select one of two languages, i.e. English and French, by selecting the corresponding button. Alternatively, a single language button may be provided, the selection of which would trigger the display of a language selection pane that would present the player with a more extensive list of available languages.

Referring back to FIG. 2, at the top right corner of the window 201, is displayed a timer 203, the purpose of which consists in informing players as to the amount of time left for placing wagers, thereby allowing players to manage the allotted time. According to one embodiment, the first phase of the game lasts sixty second, and during this phase, a message inviting players to place their wagers is displayed as overlapping the timer 203, whereas during the second phase, a message informing players that they can no longer place wagers is displayed as overlapping the timer 203, whereby misinterpretations of its role within the game are prevented. While the first phase has been described as lasting sixty seconds, it may be set to last longer or shorter according to the parameters of the game and the needs of the game's operator.

Referring back to FIG. 2, towards the bottom of the window 201, are displayed three rectangular indicators 205, 207, and 209. The indicator 205 indicates the amount of money or credits won by a player over the course of a game. As for the second indicator 207, it indicates the amount of money or credits wagered by the player over the course of the game. Finally, the indicator 209 indicates the amount of money or credits left in the player's account.

Referring back to FIG. 2, within the window 201, there can be displayed an information pane, the purpose of which consists in providing context-sensitive information to the player such as instructions regarding the manner in which the user interface should be manipulated. During the initial phase of the game, a message can be displayed within the information pane, inviting players to select a symbol should they wish to place wagers. In the top left corner of the window 201, there is displayed an information button 210, the selection of which would trigger the display of a pane specifying the rules of the game and payment schedule. Within the window 201, there can be displayed a help button, the selection of which enables players to call an attendant to their station 101 with ease and without diverting their attention from the game. The help button can be displayed as a component of the window 201 throughout the course of a game and may be selected at any time.

Referring again to FIG. 2, there are displayed a concentric ring 211 and circle 213, each of which has a distinct radius. The ring 211 is associated with the four Natural Elements; more specifically, it is equally divided into four quadrants 215 respectively associated with Earth, Air, Fire, and Water. A player may select a category of Zodiac Signs affiliated with any of the four Natural Elements by selecting a corresponding one of quadrants 215. As for the circle 213, it is displayed within the inner edge of the ring 211, and is equally divided into two semicircles 217, respectively associated with Male and Female. A player may select a category of Zodiac Signs affiliated with either one of the Genders by selecting a corresponding one of the semicircles 217.

Still referring to FIG. 2, within the window 201, there is displayed another circle 219, which is undivided, and the center of which is different from that of the ring 211 and circle 213. A player may select the Planets as variable reference points for the Alignment by selecting the circle 219.

Within the remainder of the window 201, two rings 221 and 223 and a circle 225 are displayed, each of which has a distinct radius. The outer ring 221 is equally divided into twelve sections 227, each of which presents a symbol representing a Zodiac Sign. According to one embodiment, each of the sections 227 also presents symbols representing those of the Seasons, Natural Elements, Day and Night, and Genders affiliated with the presented Zodiac Sign, wherein the symbols serve the purpose of demonstrating these affiliations. A player may select one of the twelve Zodiac Signs by selecting a corresponding one of the sections 227. As for the innermost ring 223, it is equally divided into four quadrants 229 presenting symbols representing Spring, Summer, Fall, and Winter. The innermost and outermost rings 221 and 223 are aligned such that each Zodiac Signs is aligned with a Season to which it is affiliated. A player may select a category of Zodiac Signs affiliated with either one the Seasons by selecting a corresponding one of the quadrants 229. Finally, the circle 225 is displayed within the inner edge of the ring 223, and is equally divided into two semicircles 231, each of which is affiliated with either one of Day and Night. A player may select a category of Zodiac Signs affiliated with either one of Day and Night by selecting a corresponding one of the semicircles 231.

Figure 3:
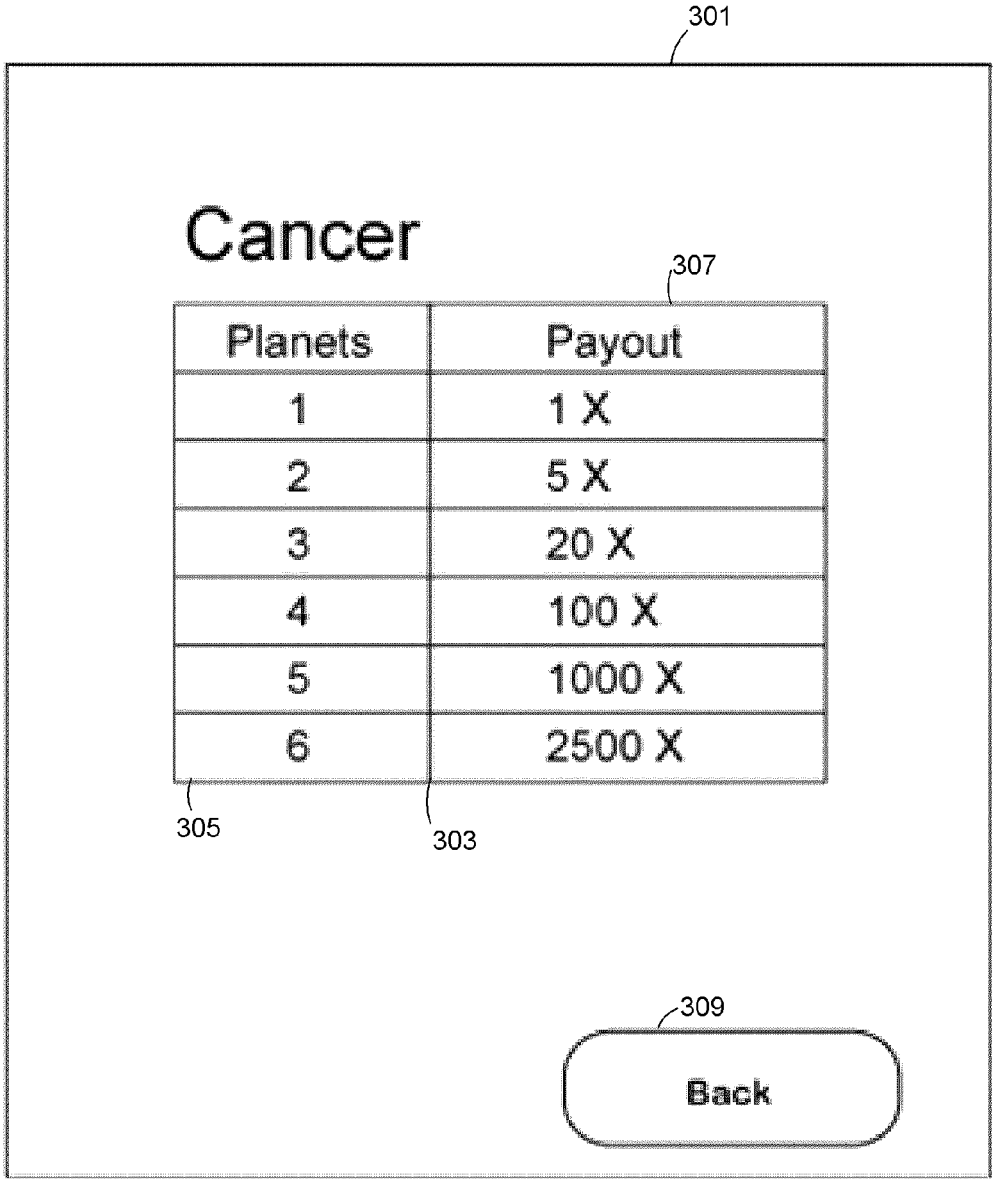
FIG. 3 illustrates a pane to be displayed over the user interface window and comprising a table describing a payment schedule for wagers on Cancer.

Once players select a category of Zodiac Signs or the alignment pattern, they may wish to consult the payment schedule associated to their selection, and may do so by selecting the information button 210, in response to which a payment schedule is displayed on the station 101. Referring now to FIG. 3, there is illustrated a pane 301 that is displayed on the station 101 when the player selects the section 227 associated to the Cancer Zodiac Sign and the information button 210. Displayed at the centre of the pane 301 is a table 303 describing a payment schedule for outcomes pertaining to the Cancer Zodiac Sign. The table 303 comprises two columns 305 and 307; the column 305 specifies a number of Planets aligned with the section 227 associated to the Cancer Zodiac Sign, and the column 307, a corresponding multiplication factor. According to the table 303, alignments of one, two, three, four, five, and six Planets with the Cancer Zodiac Sign yield payout factors of 1, 5, 20, 100, 1000, and 2500 which, with wagers in the amount of five dollars, would earn players 5, 25, 100, 500, 5000, and 12500 dollars respectively.

Figure 4:
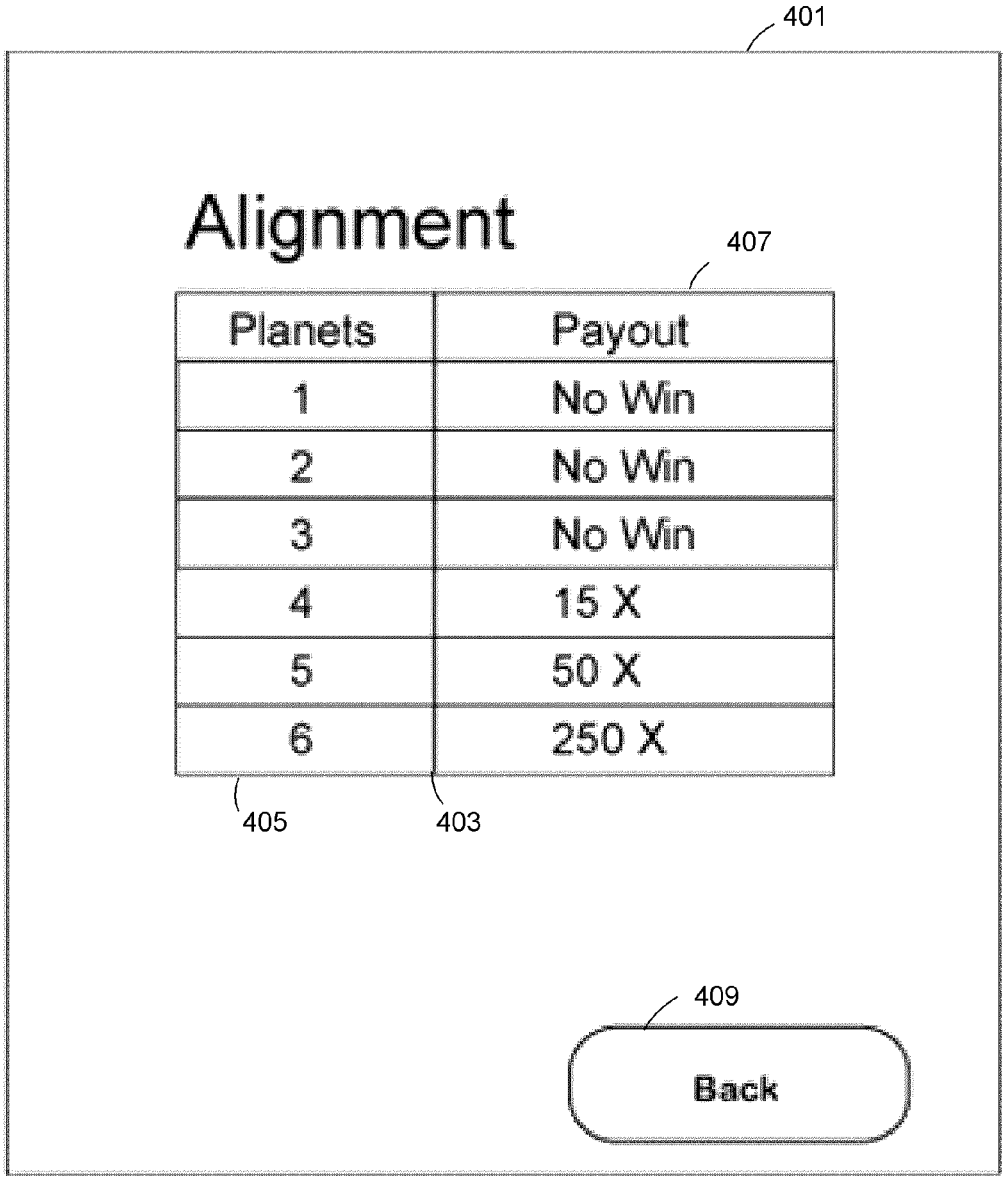
FIG. 4 illustrates a pane to be displayed over the user interface window and comprising a table describing a payment schedule for wagers on Alignment.

Referring now to FIG. 4, there is illustrated a pane 401 that is displayed on the station 101 when the player selects the circle 219 associated to the alignment pattern and the information button 210. Displayed at the centre of the pane 401 is a table 403 describing a payment schedule for outcomes pertaining to Alignment. The table 403 comprises two columns 405 and 407; the column 405 specifies a number of Planets aligned with each other, and the column 407, a corresponding multiplication factor. According to the table 403, alignments of one, two, three, four, five, and six Planets with each other yield payout factors of 0, 0, 0, 15, 50, and 250 which, with wagers in the amount of five dollars, would earn players 0, 0, 0, 75, 250, and 1250 dollars respectively.

Figure 29:
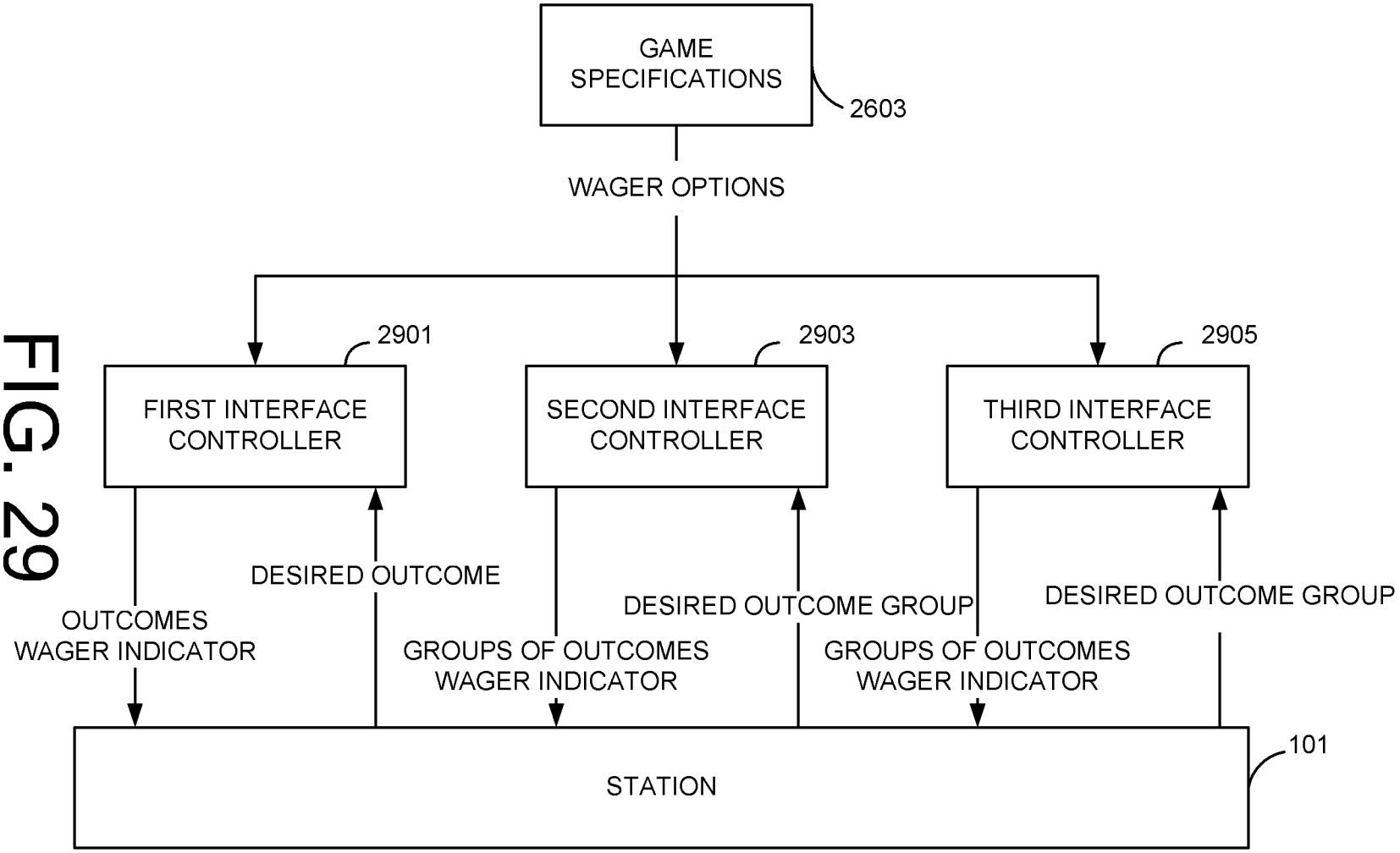
FIG. 29 is a schematic block diagram of an apparatus for placing wagers on potential outcomes of a game of chance according to one embodiment of the invention.

Referring now to FIG. 29, there is illustrated a schematic block diagram of an apparatus for placing wagers on potential outcomes of a game of chance according to one embodiment of the invention. The game specifications store 2603 provides all wagers options to a first interface controller 2901, a second interface controller 2903, and a third interface controller 2905.

The first interface controller 2901 causes a display of potential outcomes along a first ring, the second interface controller 2903 causes a display of groups of potential outcomes along a second ring, the third interface controller 2905 causes a display of groups of potential outcomes along a third ring on the station 101, wherein all three rings are concentric. The station 101 receives a wager on one of the displayed potential outcomes or displayed groups of potential outcomes, and provides the wager to a corresponding one of the first, second, and third interface controller 2901, 2903, and 2905. After receiving the wagers, the first interface controller 2901 causes a display of a circular indicator overlapping each potential outcome on which a wager has been placed, the second interface controller 2903 causes a display of a circular indicator overlapping each group of potential outcomes on which a wager has been placed, and the third interface controller 2905 causes a display of a circular indicator overlapping each group of potential outcomes on which a wager has been placed. Each of the circular indicators specifies the amount wagered on the corresponding potential outcome or group of potential outcomes. While the apparatus has been described as involving three interface controllers, it can involve a lesser or greater number of interface controllers. Furthermore, while the display of potential outcomes and groups thereof has been described as positioned along rings, it can be positioned along other closed shapes, such as concentric square frames.

The resulting wager interface is illustrated in FIG. 2. Immediately below the ring 221 are displayed five circular buttons 233 the selection of which increases the amount wagered by 1, 5, 10, 25, and 100 dollars respectively. A circular indicator is displayed as overlapping the selected one of the sections 227, quadrants 215 and 229, semicircles 217 and 231, and the circle 219, the circular indicator informing the player of the total amount wagered. However, if following the aforementioned manipulation, the amount to be wagered displayed in the circular indicator is not to the player's satisfaction, it may be erased by selecting a button 235 displayed below the indicator 209. Alternatively, the last amount added to the wager indicated in the circular indicator may be undone by selecting a button 237.

In traditional Roulette games, a winning outcome consists in an alignment of one ball with one of a set of reference points. However, in accordance with one embodiment of the present invention, wagers may be placed on series of outcomes that exclusively involve alignments of at least two balls with respect to sets of reference points, whereby a greater sense of near-win is imparted to players. For instance, of the six possible numbers of Planets aligned with members of the Water group, the four winning ones consist in an alignment of at least two Planets with Signs affiliated thereto. As for the two losing outcomes, the first one excludes any alignment of Planets with a corresponding Sign while the second one consists in the alignment of exactly one Planet with a corresponding Sign. While none of the two losing outcomes reward wagers placed on Water, the latter is of greater entertainment value as it is closer to a winning outcome.

During this first phase, although the attention of the players is mainly focused on their stations 101, a visual interface is nonetheless displayed on the communal panel 103. The visual interface is generated by an apparatus illustrated in FIG. 30, and serves the purpose of identifying in real-time the stations 101 from which each wager is placed. Upon receiving a wager from a player, the first station 101 sends a wager signal to a wager sequencer 3001, the wager signal identifying the wager and the first station 101. Similarly, upon receiving a wager from a player, the second station 101 sends a wager signal to the wager sequencer 3001, the wager signal identifying the wager and the second station 101. The wager sequencer 3001 provides the wager signals received from the stations 101 successively, in the order in which they were provided by the first and second stations 101 to an interface controller 2609, which causes a real-time display of visual indicators identifying the stations 101 from which each of the wagers was placed.

Figure 5:
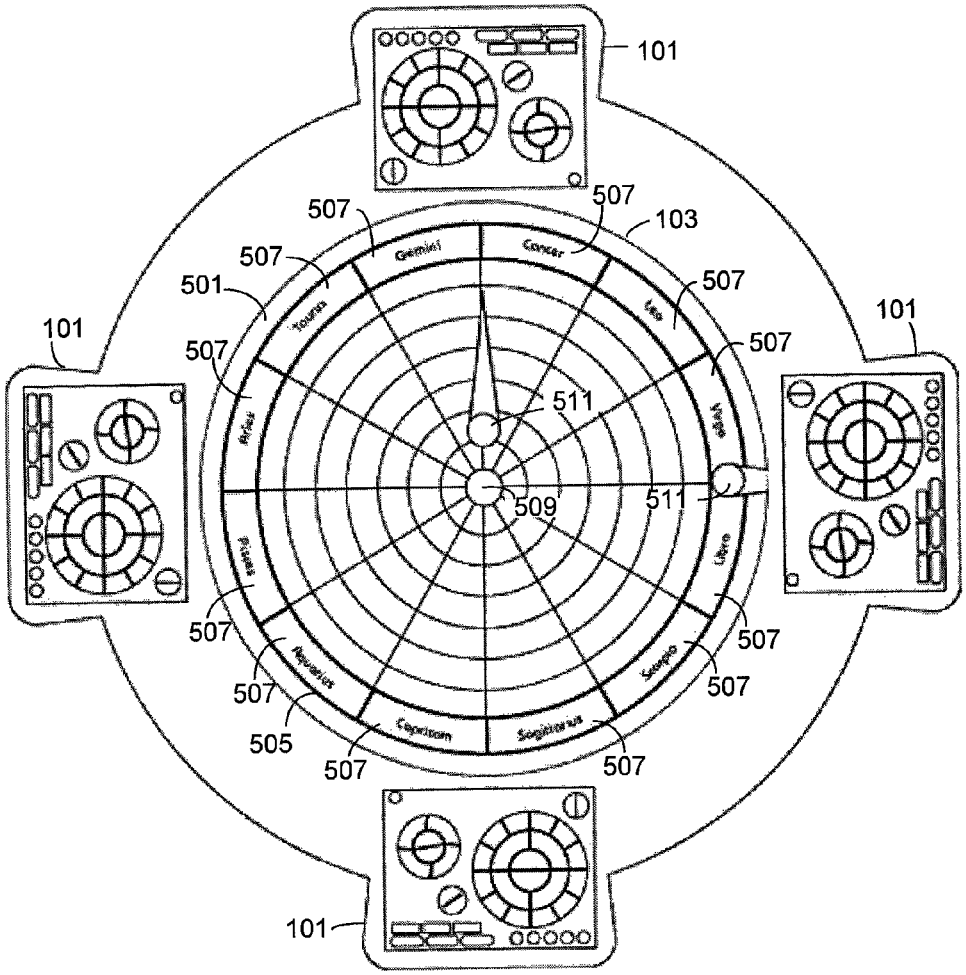
FIG. 5 illustrates a first state of a visual interface displayed on the communal panel, the visual interface providing an indication as to stations from which and times at which wagers are placed.
Figure 30:
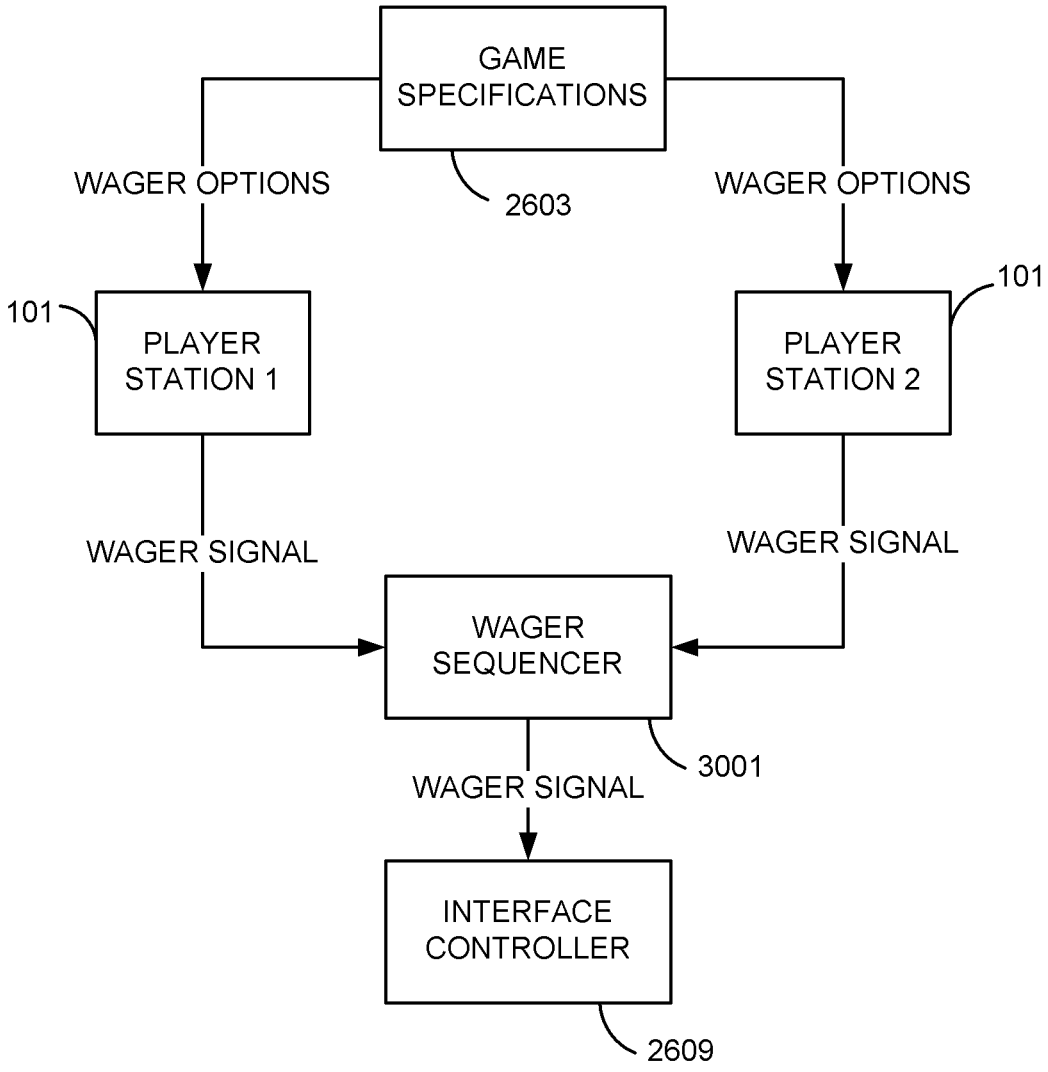
FIG. 30 is a schematic block diagram of an apparatus for identifying in real-time, and to the players, the stations from which each wager is placed.

Referring now to FIG. 5, there is illustrated a visual interface 501 displayed on the communal panel 103 during the first phase, as generated by the apparatus presented in FIG. 30.

Figure 6:
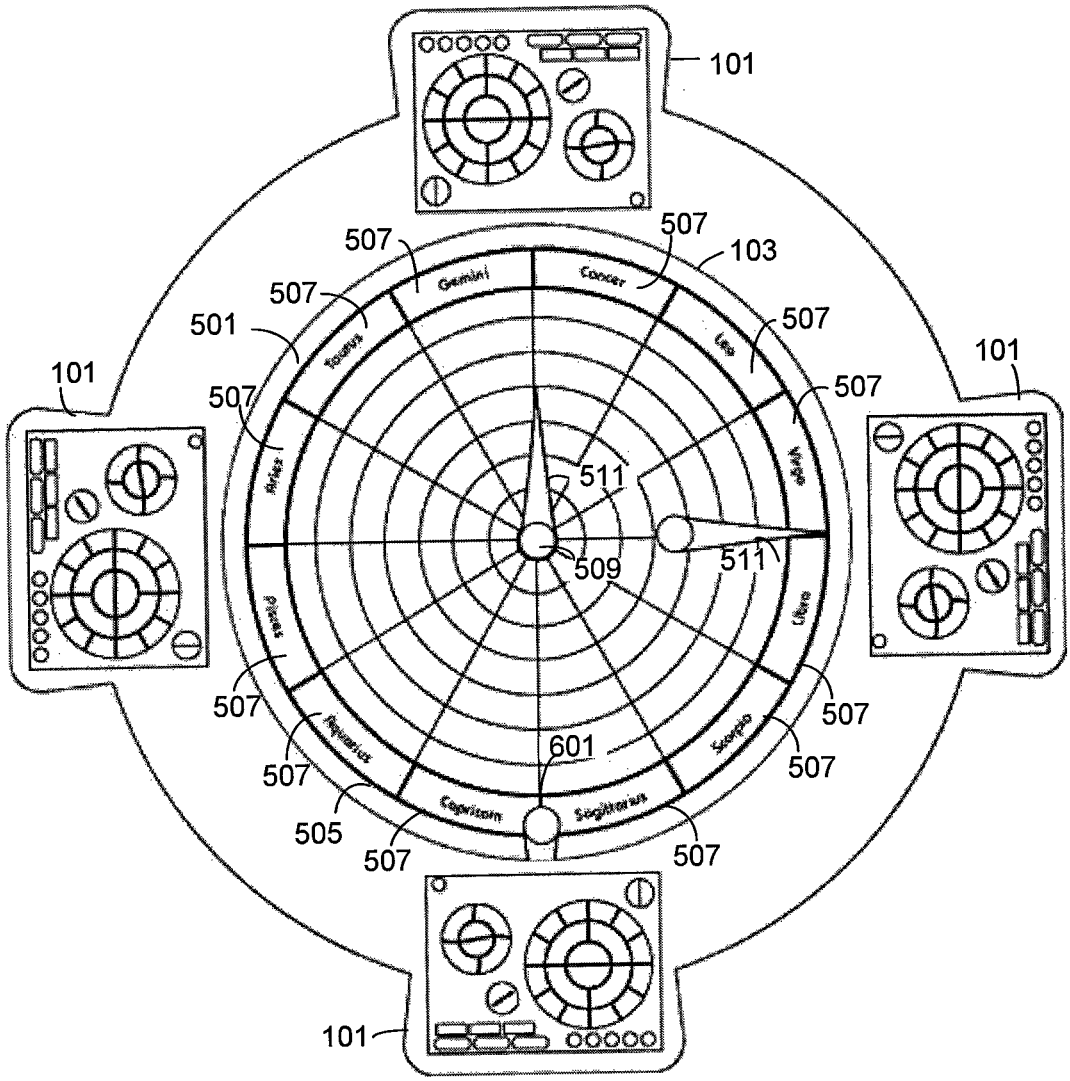
FIG. 6 illustrates a second state of the visual interface displayed on the communal panel, the visual interlace providing an indication as to stations from which and times at which wagers are placed.

The interface 501 comprises a ring 505 equally divided into twelve sections 507, each of which presents a symbol representing one of the twelve Signs. A substantially circular symbol 509 represents the Sun. In accordance with one embodiment of the present invention, for each wager placed by a player, a light beam 511 is displayed on the panel 103 as projected from the corresponding station 101 towards the Sun 509. The purpose of the beams consists in providing a clear, intuitive, and entertaining indication as to the stations 101 from which and the times at which wagers are placed during the first phase, thereby promoting excitement among the players. FIG. 5 and FIG. 6 illustrate two states of the interface to be successively displayed on the communal panel 103 during the initial phase of the game. In FIG. 5, two light beams 511 are displayed as projected from two distinct stations 101, wherein each one is indicative of a wager placed from a corresponding one of the stations 101. In FIG. 6, on the other hand, the two previous beams 511 are shown during later stages of their journey towards the Sun 509 and a new light beam 601 is displayed as projected from a third one of the stations 101, wherein the new beam 601 is indicative of a wager subsequent to the previous two and placed from the third station 101. It will be appreciated that visual indicators other than the beams 511 and 601 can be used to indicate that a wager has been placed from a specific one of the stations 101. According to one embodiment, the visual indicator is a symbol of the selected wager option, and the size of the symbol indicates the size of the wager.

Figure 7:
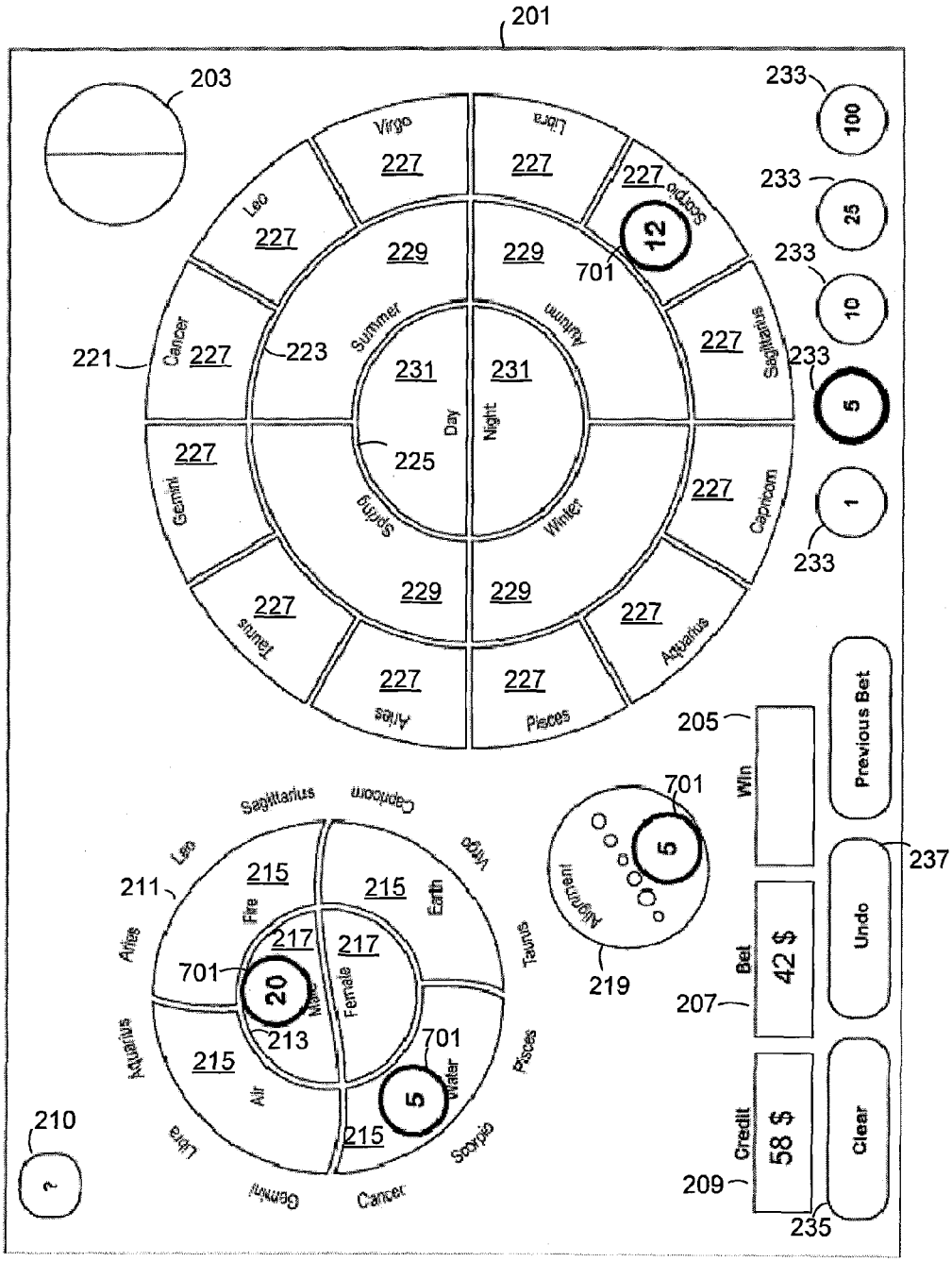
FIG. 7 illustrates the user interface window providing an indication with respect to previously placed wagers during a second phase of the game.

Upon expiry of the initial phase, players are informed that they may no longer place wagers; however, and in accordance with one embodiment of the present invention, the window 201 remains displayed for the purpose of providing players with an indication as to their wagers while they wait for the game's results to be displayed on the communal panel 103. Since wagers are not allowed during this second phase of the game, the interactivity of the window 201 is disabled. FIG. 7 illustrates the window 201 to be displayed on the station 101 during the second phase of the game, wherein four circular indicators 701 overlap the quadrant 215 associated with Water, the semicircle 217 associated with Male, the sections 227 associated with Scorpio, and the circle 219 associated with the alignment pattern to remind the player of the 5, 20, 12, and 5 dollars respectively wagered on corresponding wager options.

Referring back to FIG. 27, during a second phase of the game, a predetermined number of outcomes are randomly selected from a plurality of available outcomes in a step 2703. It is important to note that within the context of an embodiment of the game in which each outcome designates both a Zodiac Sign and a position, the selection of a predetermined number of outcomes results in a selection of the predetermined number of positions referred to in a step 2805 of FIG. 28.

Referring back to FIG. 26, the game specifications store 2603 provides all potential outcomes to the game controller 2607, which randomly selects one of the provided outcomes. The game controller 2607 iterates through the selection process until a predetermined number of outcomes are randomly selected. The number of iterations with respect to the number of potential outcomes is such that each of the potential outcomes has odds equal to or greater than 25% of being selected. According to one embodiment, the odds are at least equal to or greater than 30%.

According to one embodiment, the game controller 2607 comprises a random number generator for selecting each of the randomly selected outcomes. According to another embodiment, the game controller 2607 comprises a ball and a roulette wheel, and the selection process is achieved by propelling the ball around a track of the wheel, and identifying the indentation of the wheel in which the ball lands as the randomly selected outcome. The game controller 2607 provides each of the selected outcomes to an interface controller 2609, which causes a display of the selected outcomes to the players.

With respect to the version of the game described herein, and still during the second phase, a component of the communal system, namely the Draw Module, or the game controller 2607, randomly selects one of the twelve Signs with which each of the six Planets is to be aligned following its revolutions around the Sun 509. While the Signs are selected, the attention of the players is called to the communal panel 103 as the visual interface 501 that had been displayed during the first phase is progressively modified.

Figure 8:
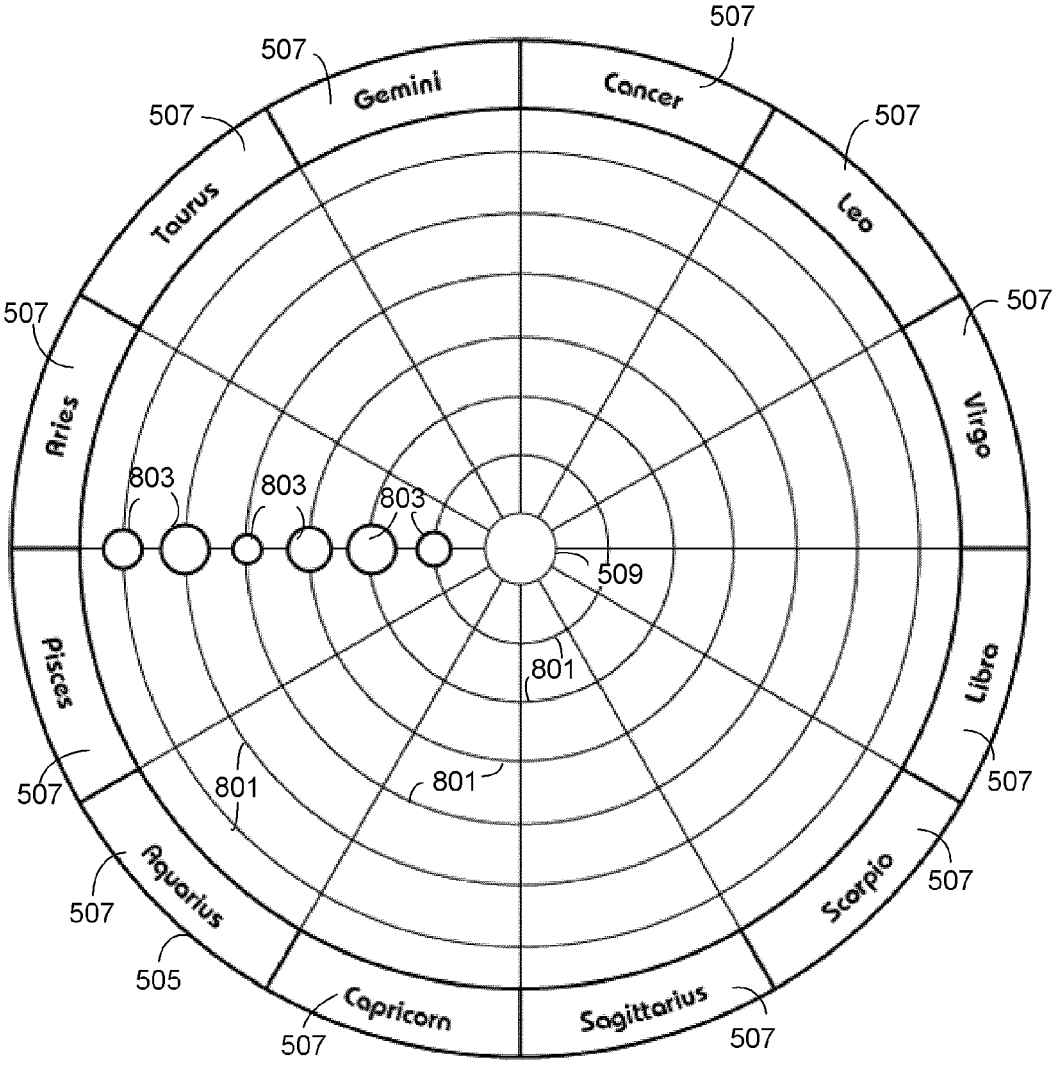
FIG. 8 illustrates a state of the visual interface providing the initial positions of six Planets along their respective orbits during the second phase of the game.

Referring to FIG. 8, six equally-spaced, concentric rings are positioned between the Sun 509 and the ring 505, each of which represents the orbit 801 of one of six Planets 803, the modification consisting in the additional display of six circular symbols aligned with the Sun 509, each of which represents one of the Planets 803 positioned on its orbit 801.

As mentioned herein above, by reducing the number of constant reference points the complexity of the game is decreased, which is particularly advantageous as it increases the speed with which new players learn the rules of the game and the ease with which established players follow the course of a game. However if the number of constant reference points of a traditional Roulette game were to be reduced in a straightforward manner, the probability of each outcome would increase and the payout factors associated thereto would decrease, which would likely compromise the appeal of the game to at least some of the patrons. Therefore, and in accordance with the present invention, the number of balls is increased to provide for low-probability outcomes, at least some of which yield payout factors of substantial magnitude, wherein each of the outcomes is a compound of higher probability events, and whereby the reduction of the number of constant reference points does not compromise the appeal of the game. As a matter of fact, the particular embodiment described herein involves six balls and twelve reference points, thereby providing for outcomes having lower probabilities and yielding greater payout factors than the lowest probability outcomes of traditional Roulette games. Furthermore, the combination of a lesser number of reference points and a greater number of balls provides for a wider variety of high-probability outcomes, at least some of which are associated to moderate payout factors, in comparison with traditional Roulette-based games. It will be appreciated that a person skilled in the art of game probabilities will determine that although each of the twelve outcomes is selected 0.5 times on average, the probability that an outcome is selected at least once is less than 50%. In fact, the probability that none of the six random selections matches a specific outcome is approximately 60%. Also, the probability that an outcome is selected exactly once is 28%, twice, 7%, three times, 0.9%, four times, 0.06%, five times, 0.002%, and six times, 0.00003%. By multiplying the number of selections with the corresponding probabilities, the skilled person would reach the average number of selections, namely 0.5.

Figure 9:
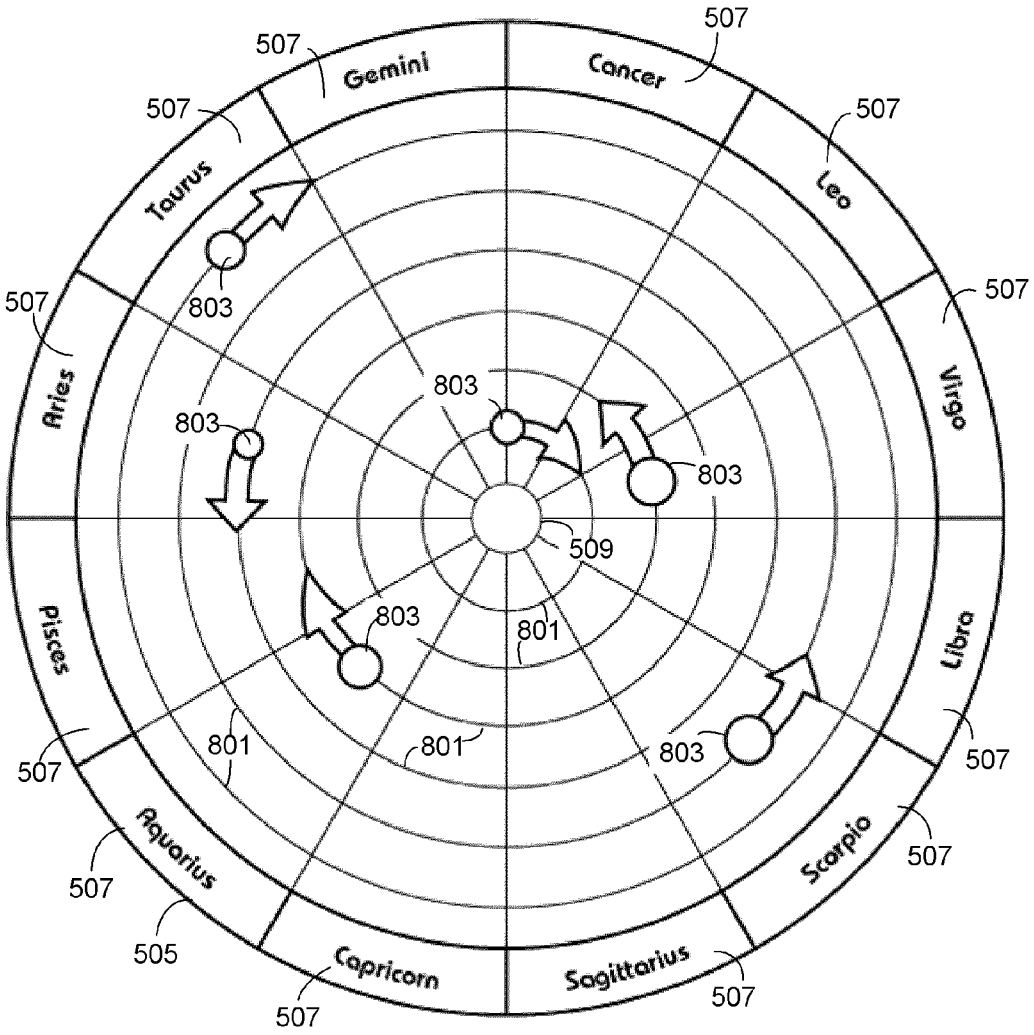
FIG. 9 illustrates a state of the visual interface wherein the Planets are revolving around the Sun during the second phase of the game.
Figure 10:
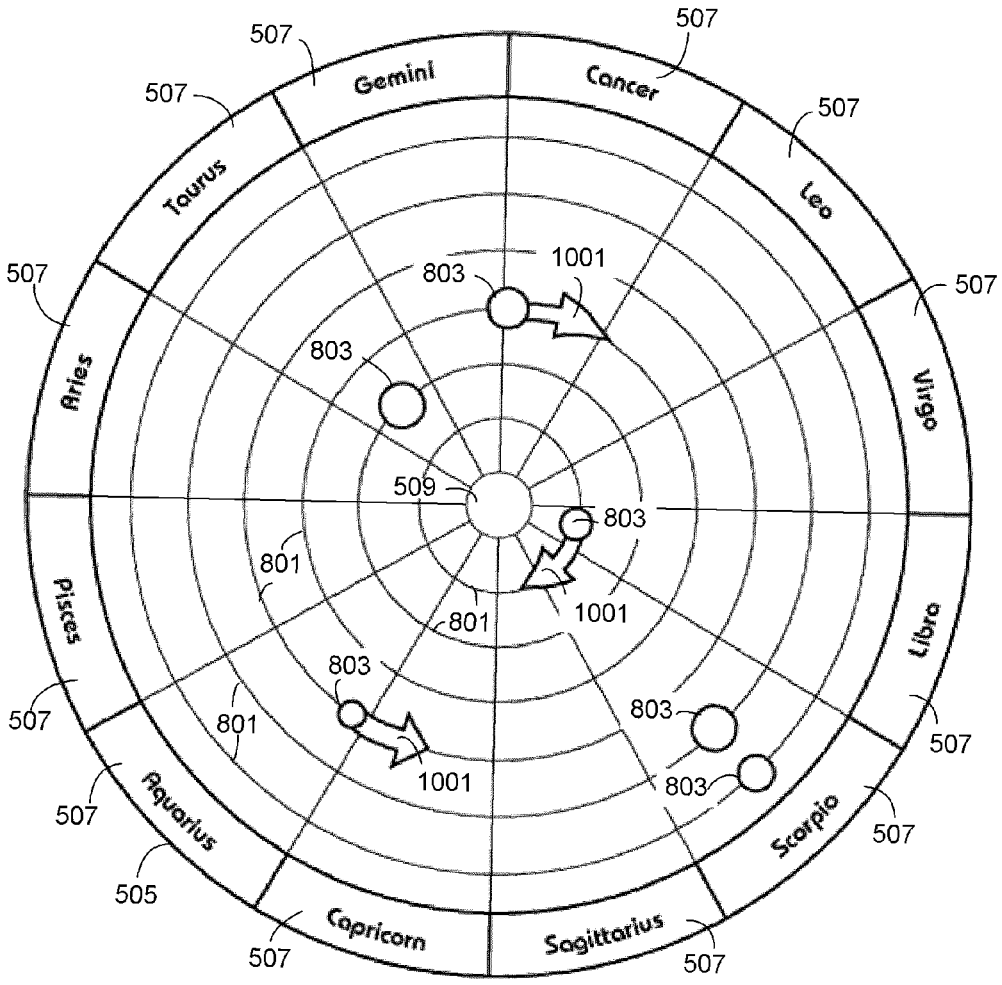
FIG. 10 illustrates a state of the visual interface wherein three Planets have reached their final destinations while three others are pursuing their revolutions around the Sun.
Figure 11:
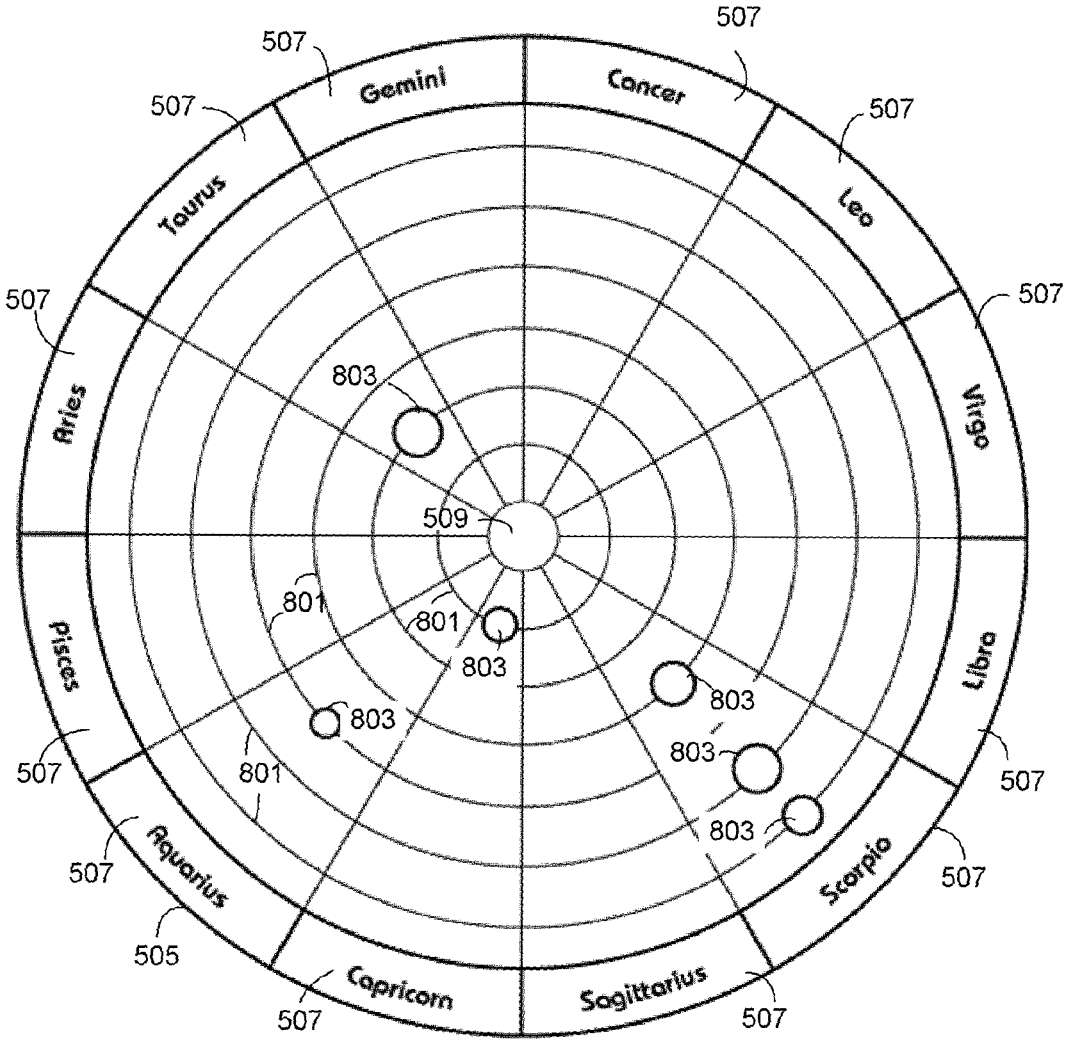
FIG. 11 illustrates a state of the visual interface wherein all six Planets have reached their final destinations.

Following their display on the communal panel 103, the Planets 803 are simultaneously set in motion along their orbits 801 and revolve around the Sun 509 as a function of their respective speed and rotational direction, as illustrated in FIG. 9. After a few revolutions around the Sun 509, the Planets 803 successively reach their final destinations, which had been previously selected by the game controller 2607. In the example illustrated in FIG. 10, three of the six Planets 803 are displayed as having reached their final destinations, one of which is aligned with the section 507 assigned to Taurus and two of which are aligned with the section 507 assigned to Scorpio, while the others are displayed as pursuing their revolutions around the Sun 509, as indicated by their motion arrows 1001. FIG. 11 illustrates the final arrangement of the Planets 803 along their respective orbits 801; three of them are respectively aligned with the sections 507 assigned to Taurus, Aquarius, and Capricorn while the remaining three are aligned with the section 507 assigned to Scorpio.

Referring back to FIG. 27, and according to a step 2705, as outcomes are randomly selected, they are compared with the desired outcome in order to determine the number of times the desired outcome is selected during a predetermined number of plays. If the desired outcome is selected at least once, and according to a step 2709, a payout is calculated as a function of the wager and the number of times the desired outcome is selected. Finally, in a step 2711, the calculated payout is provided to the player. According to one embodiment, the payout factor increases with each selection of the desired outcome. Depending on the number of potential outcomes with respect to the number of selections, a sufficient number of selections of the desired outcome can be assigned a payout factor greater than 100 or 1000.

Referring back to FIG. 26, as outcomes are selected by the game controller 2607, they are provided to a win controller 2605, which compares them to the desired outcome of the wager selection provided by the station 101. For each match, the win controller 2605 provides a win signal along with the wager selection to a multiple game win collector 2611, which counts the number of win signals provided for each wager selection over the course of a predetermined number of plays. The total number of win signals for each wager selection is provided to a multiple game play payout controller 2613, which calculates the payout, if any, and provides the payout to the station 101.

Referring back to FIG. 28, and according to a step 2807, the number of combinations of selected positions forming the defined pattern is counted. If at least one combination forms at least one of the defined pattern, and according to a step 2811, a payout is calculated as a function of the wager, the number of combinations forming the defined pattern, and the number of positions included in each of the combinations.

Referring back to FIG. 26, once the win controller 2605 is provided with all selected outcomes, the win controller 2605 searches for the defined pattern within the corresponding positions, and provides a win signal for each identified pattern to the multiple game win collector 2611, which combines the win signals. The latter signals are provided to the multiple game play payout controller 2613, which provides a payout to the station 101.

Figure 12:
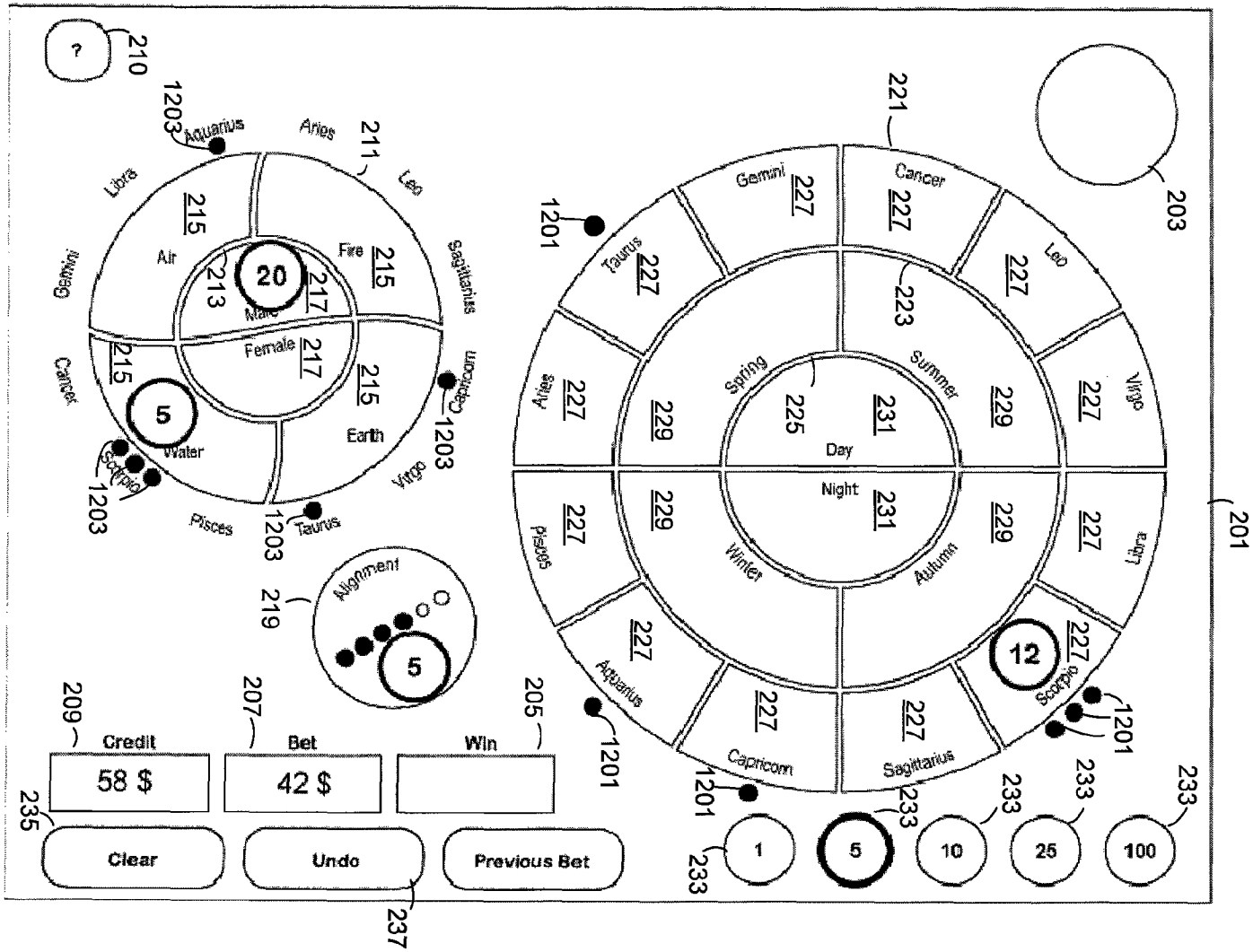
FIG. 12 illustrates a state of the user interface window providing an indication as to results of the draw during a third phase of the game.

Once the results of the draw are generated and displayed on the communal panel 103, the players are lead to the third and final phase of the game during which the windows 201 displayed on the stations 101 demonstrate the manner in which the results of the draw are to be interpreted. FIG. 12 illustrates the window 201 as it specifies the results of the draw, winning outcomes established as a function of the results, and gains registered on the station 101 on which it is displayed.

Referring now to FIG. 12, within the window 201, six circular markers 1201, each of which represents one of the six Planets 803 displayed on the communal panel 103, are successively displayed along the ring 221 as the Planets 803 reach their final destinations. The markers 1201 are aligned with specific sections 227 of the ring 221 to reflect alignments of the Planets 803 and the sections 507 assigns to the Signs displayed on the communal panel 103. Furthermore, at least some sections of the rings 211, 221, 223, and the circles 213, 219, and 225 displayed within the window 201 are highlighted to inform players of those of the categories for which winning outcomes had been reached.

According to one embodiment, there is displayed on the station 101 a results pane divided in rows, each of which identifies the category to which one of the winning outcomes pertains, the number of the Planets 803 aligned with the sections 507 assigned to members of the category, as well as the corresponding multiplication factor. Also, and still within the results pane, each row describing a winning outcome pertaining to a category on which the player had wagered is highlighted and each immediately following row identifies the wagered amount as well as the amount to be credited to the player's account.

Figure 31:
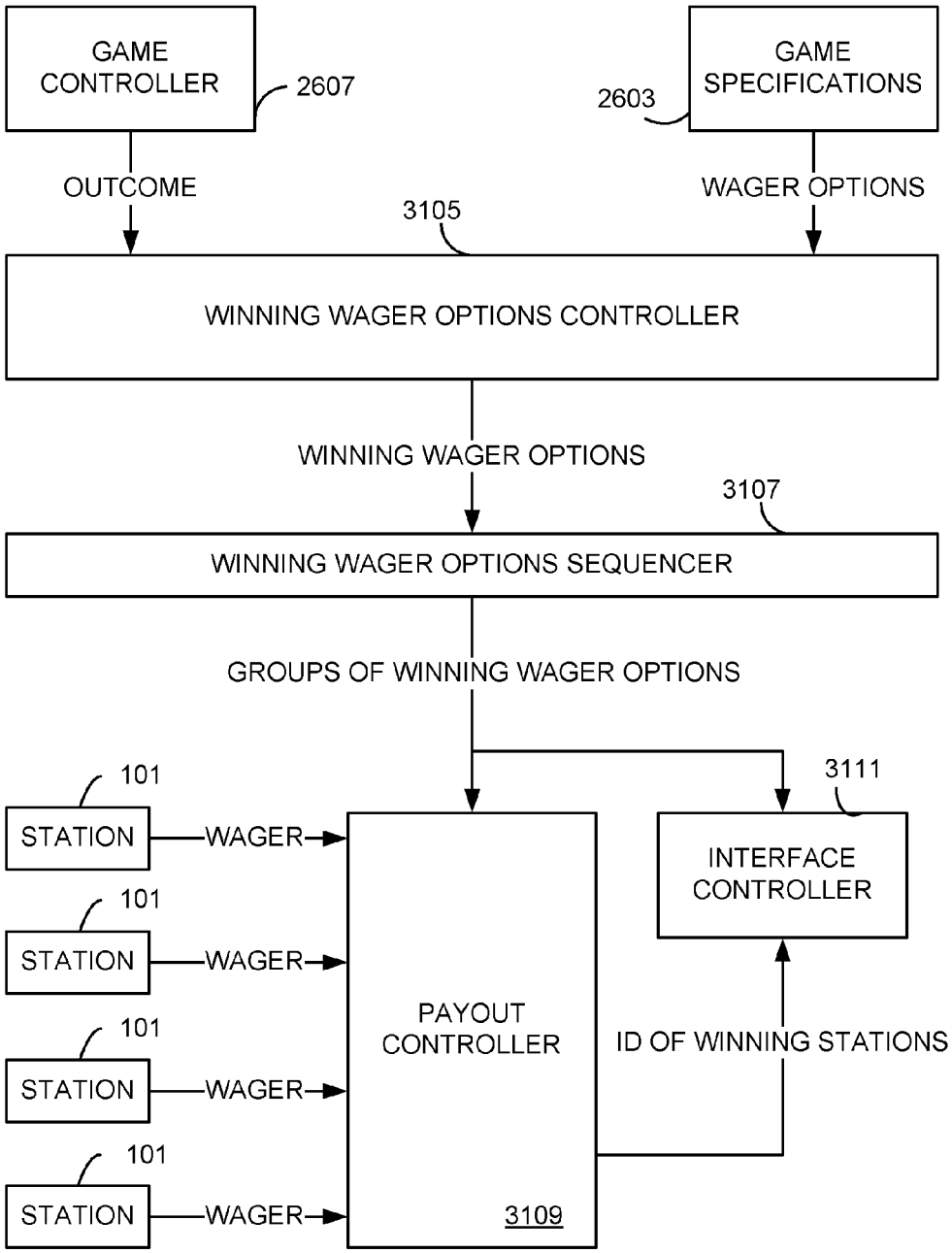
FIG. 31 is a schematic block diagram of an apparatus for demonstrating winning wager options in a game of chance in which players can place wagers on a plurality of available options.

In order to avoid cluttered panes, and according to the present invention, winning outcomes are demonstrated in a successive manner thereby promoting an understanding of available betting or wager options and their associated probabilities among players. Referring to FIG. 31, there is provided a schematic block diagram of an apparatus for demonstrating winning wager options or groups thereof in a successive manner.

The game controller 2607 provides randomly selected outcomes, and a game specifications store 2603, wager options to a winning wager options controller 3105, which compares the outcomes and options and identifies winning ones of the wager options. The latter options are provided to a winning wager options sequencer 3107, which groups winning wagers according to a predetermined criterion, and provides each of the formed groups to a payout controller 3109 and an interface controller 3111. The stations 101 provide placed wagers to the payout controller 3109, which compares them with the winning wager options, identifies winning ones of the stations 101 for each group of winning wager options, and provides the identity of the winning stations 101 to the interface controller 3111. Finally, the interface controller 3111 causes a display of a most recently provided group of winning wager options and visual indicators identifying the winning stations 101 corresponding to the group. According to the preferred embodiment, the visual indicators also specify the payout provided to each of the winning stations 101. According to one embodiment, each group of wager options comprises at least two wager options. According to another embodiment, each group of wager options comprises exactly one wager option.

Within the context of the specific embodiment described, the third phase is divided into six sub-phases, a first of which deals with winning outcomes or winning wager options pertaining to Signs, a second of which deals with those pertaining to Seasons, a third of which deals with Natural Elements, a fourth of which deals with Day and Night, a fifth of which deals with Gender, and a sixth of which deals with Alignment. FIG. 13 to FIG. 18 illustrate six states of the user interface window 201, each of which is to be displayed during a corresponding one of the six sub-phases.

Figure 13:
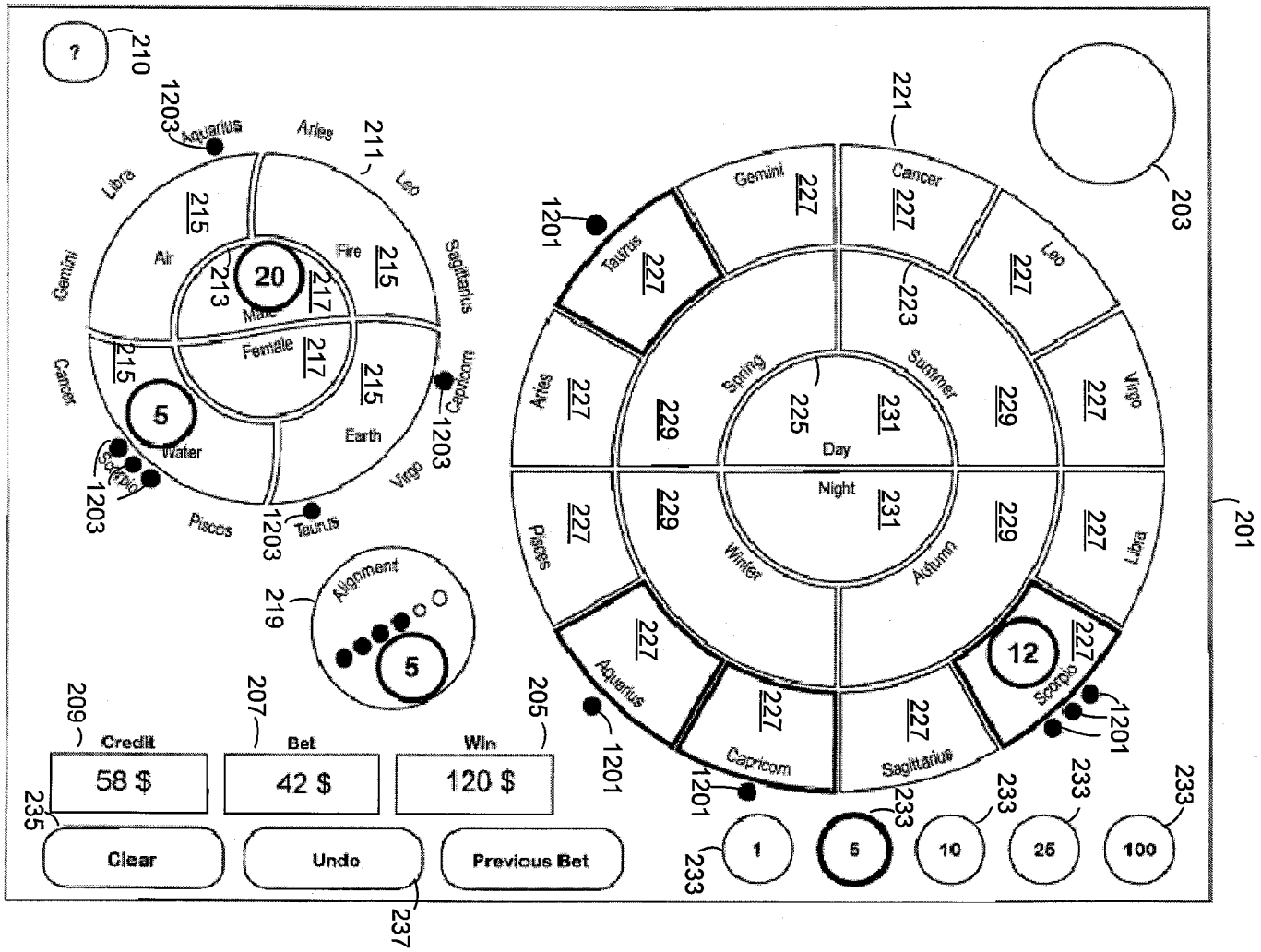
FIG. 13 illustrates a state of the user interface window demonstrating winning wager options pertaining to Zodiac Signs.

FIG. 13 illustrates a state of the window 201 identifying winning outcomes or winning wager options pertaining to Zodiac Signs. Since the Planets 803 are aligned with Capricorn, Aquarius, and Taurus, and Scorpio, those of the sections 227 of the ring 221 representing the latter Signs are highlighted.

Figure 14:
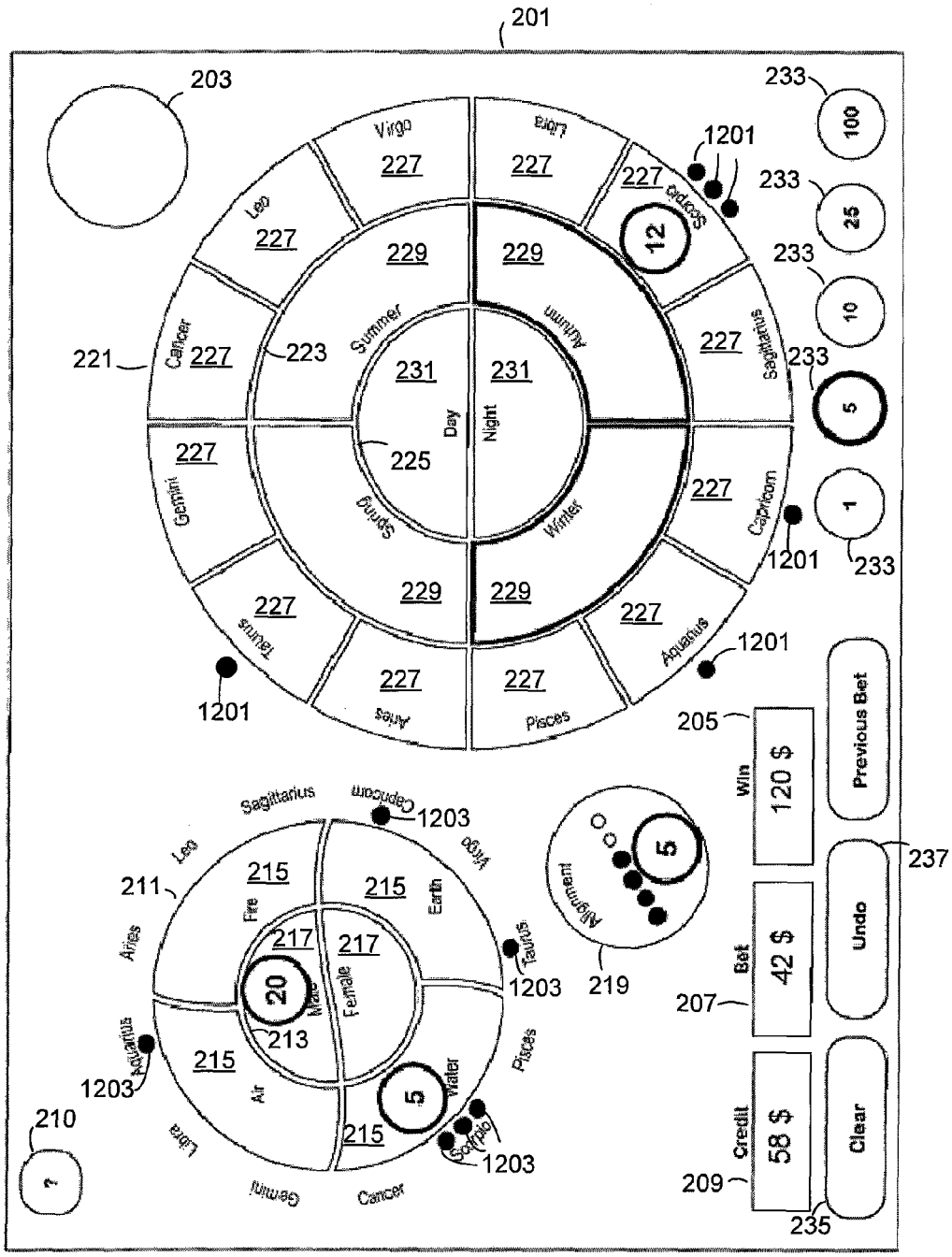
FIG. 14 illustrates a state of the user interface window demonstrating winning wager options pertaining to Seasons.

FIG. 14 illustrates a state of the window 201 identifying winning wager options pertaining to Seasons. Since two Planets 803 are aligned with two Signs affiliated with Winter, namely Capricorn and Aquarius, and three Planets 803 are aligned with Scorpio, which is affiliated to Fall, those of the sections 229 assigned to Winter and Fall are highlighted.

Figure 15:
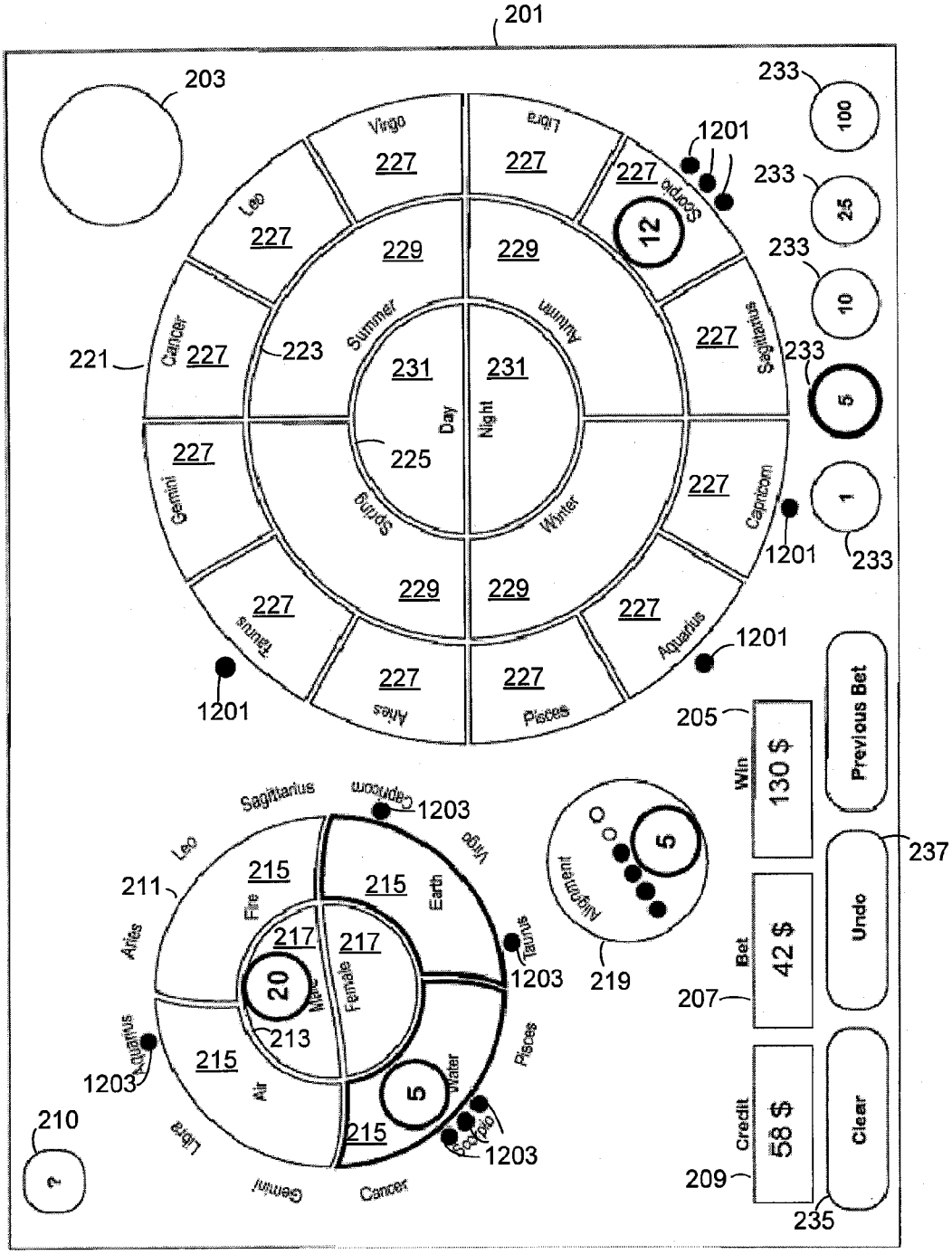
FIG. 15 illustrates a state of the user interface window demonstrating winning wager options pertaining to Natural Elements.

FIG. 15 illustrates a state of the window 201 identifying winning wager options pertaining to Natural Elements. Since two of the Planets 803 are aligned with Zodiac Signs affiliated with Earth, namely Capricorn and Taurus, and three Planets 803 are aligned with Scorpio, which is affiliated with Water, those of the quadrants 229 assigned to Earth and Water are highlighted. It is important to note that in order for the draw to yield a winning wager option pertaining to Natural Elements, at least two of the six Planets 803 have to be aligned with Signs affiliated with a same one of the Natural Elements. For instance, the alignment of one of the Planets 803 with a Sign affiliated with Air, namely Aquarius, does not yield a winning wager option and therefore, the one of the quadrants 215 assigned to Air is not highlighted.

Figure 16:
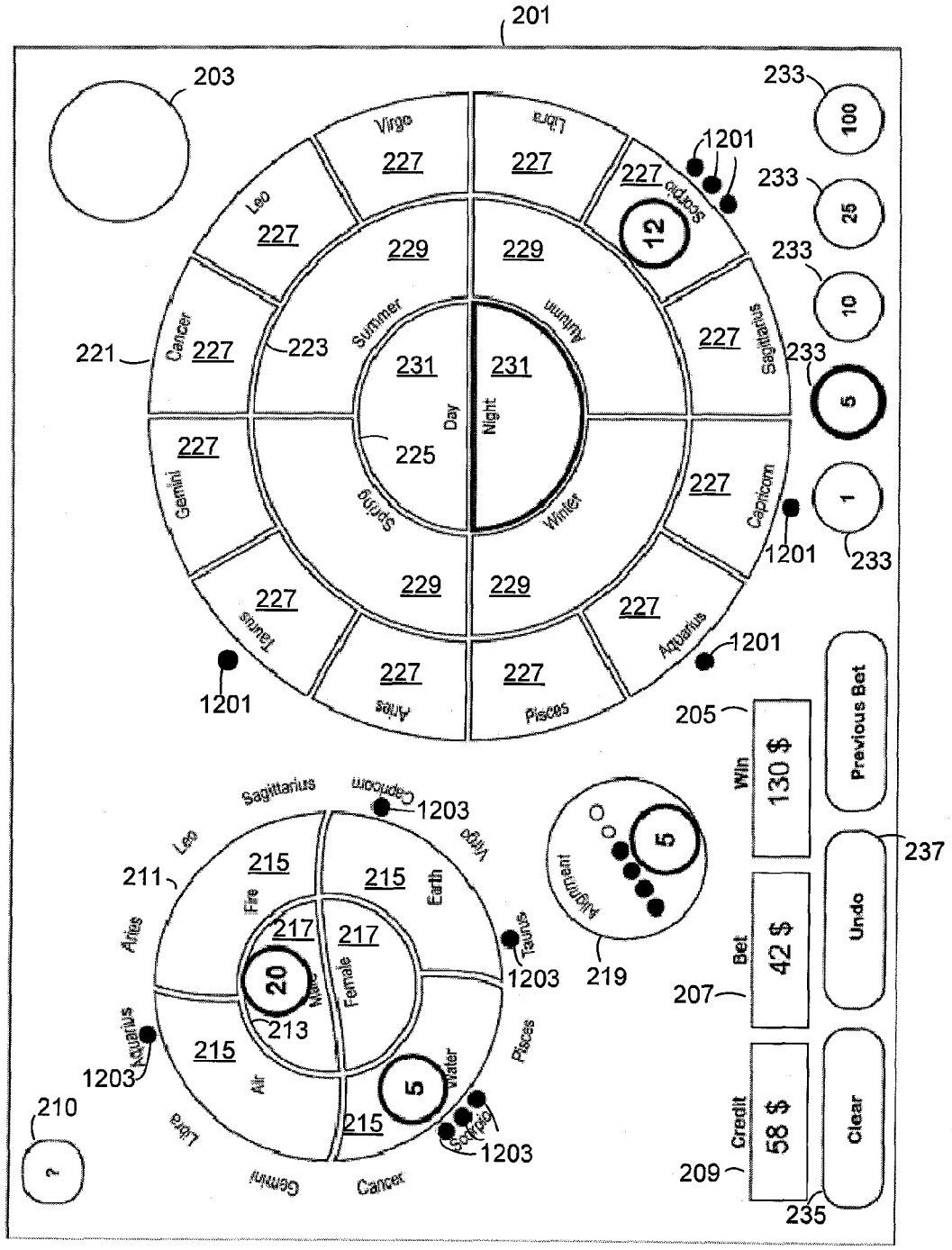
FIG. 16 illustrates a state of the user interface window demonstrating winning wager options pertaining to Day and Night.

FIG. 16 illustrates a state of the window 201 identifying winning outcomes or winning wager options pertaining to Day and Night. Since five Planets 803 are aligned with Signs affiliated with Night, namely one with Capricorn, another with Aquarius, and three with Scorpio, the one of the sections 231 assigned to Night is highlighted.

Figure 17:
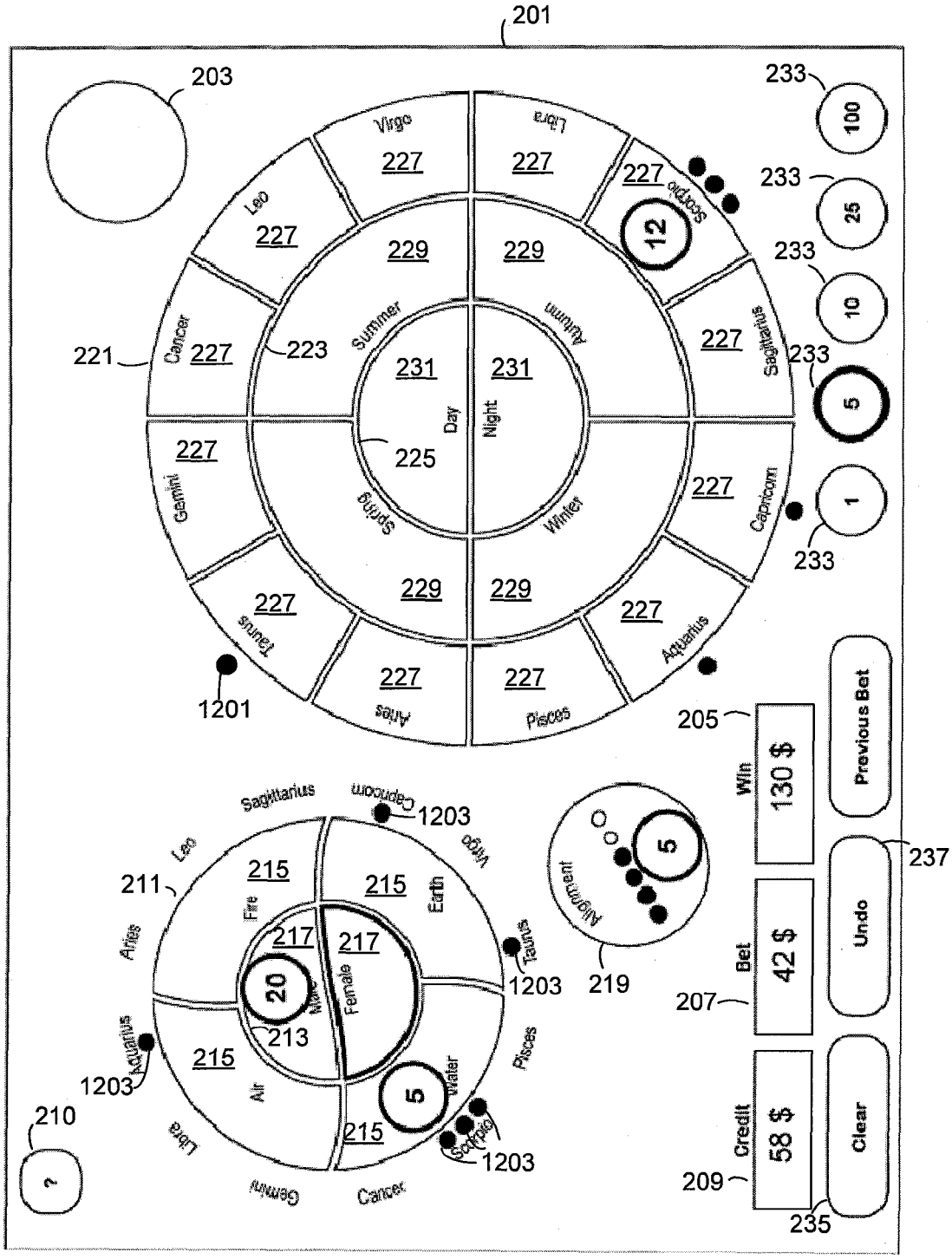
FIG. 17 illustrates a state of the user interface window demonstrating winning wager options pertaining to Gender.

FIG. 17 illustrates a state of the window 201 identifying winning wager options pertaining to Gender. Since five of the Planets 803 are aligned with three Zodiac Signs affiliated with Female, namely Capricorn, Taurus, and Scorpio, the one of the sections 217 assigned to Female is highlighted.

Figure 18:
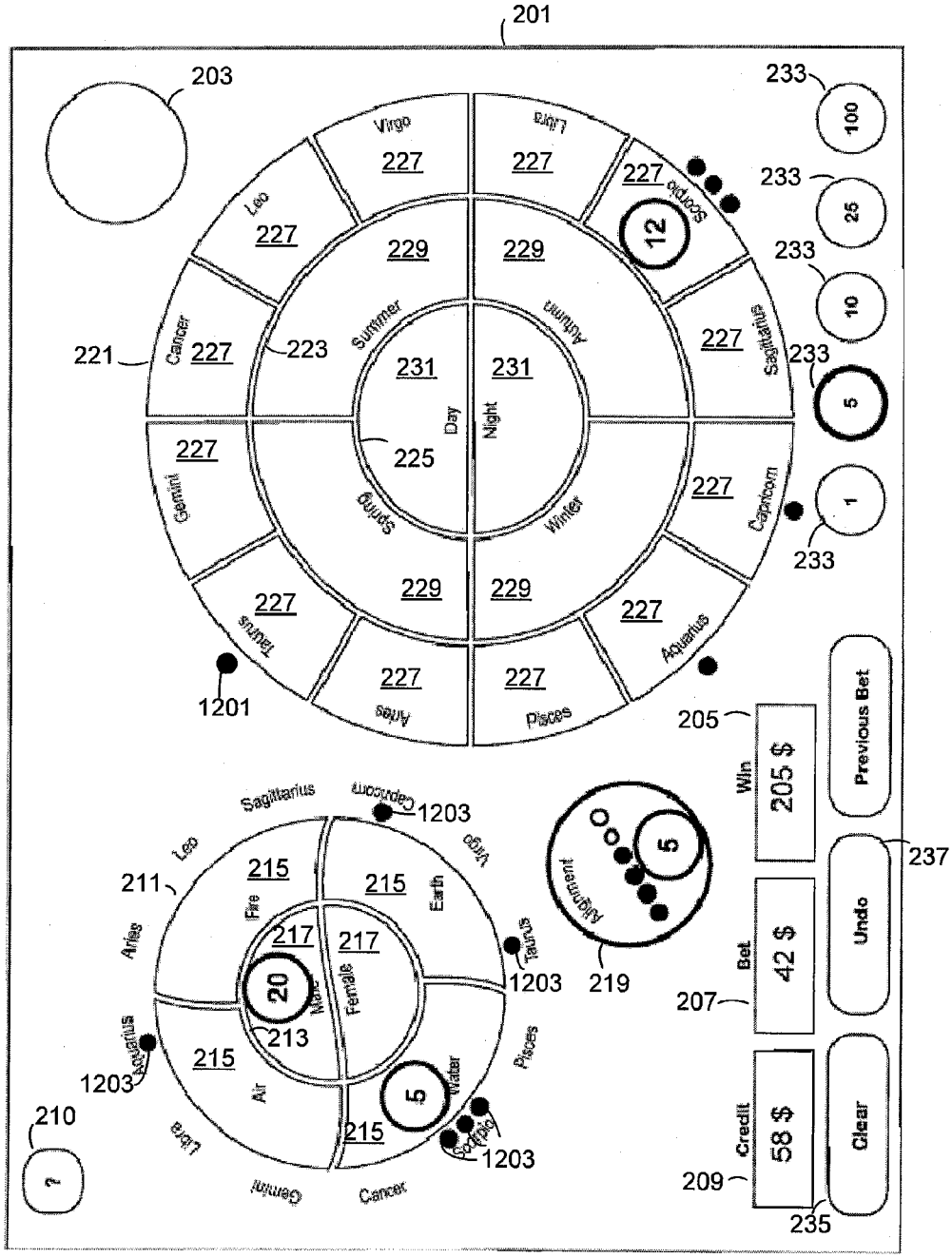
FIG. 18 illustrates a state of the user interface window demonstrating winning wager options pertaining to Alignment.

FIG. 18 illustrates a state of the window 201 identifying winning wager options pertaining to the alignment pattern. Since four of the six Planets 803 are aligned, the circle 219 is highlighted.

In order to avoid a cluttered visual interface, and according to one embodiment of the present invention, winning outcomes or winning wager options are demonstrated in a successive manner thereby promoting an understanding of available betting options and their associated probabilities among players. More specifically, the outcome phase is divided into six phases, a first of which deals with Zodiac Signs, a second of which deals with Seasons, a third of which deals with Natural Elements, a fourth of which deals with Gender, a fifth of which deals with Day and Night, and a last of which deals with the Planets 803 themselves. FIG. 19 to FIG. 25 illustrate the six states of the visual interface 501, each of which is to be displayed during a corresponding one of the six sub-phases.

Figure 19:
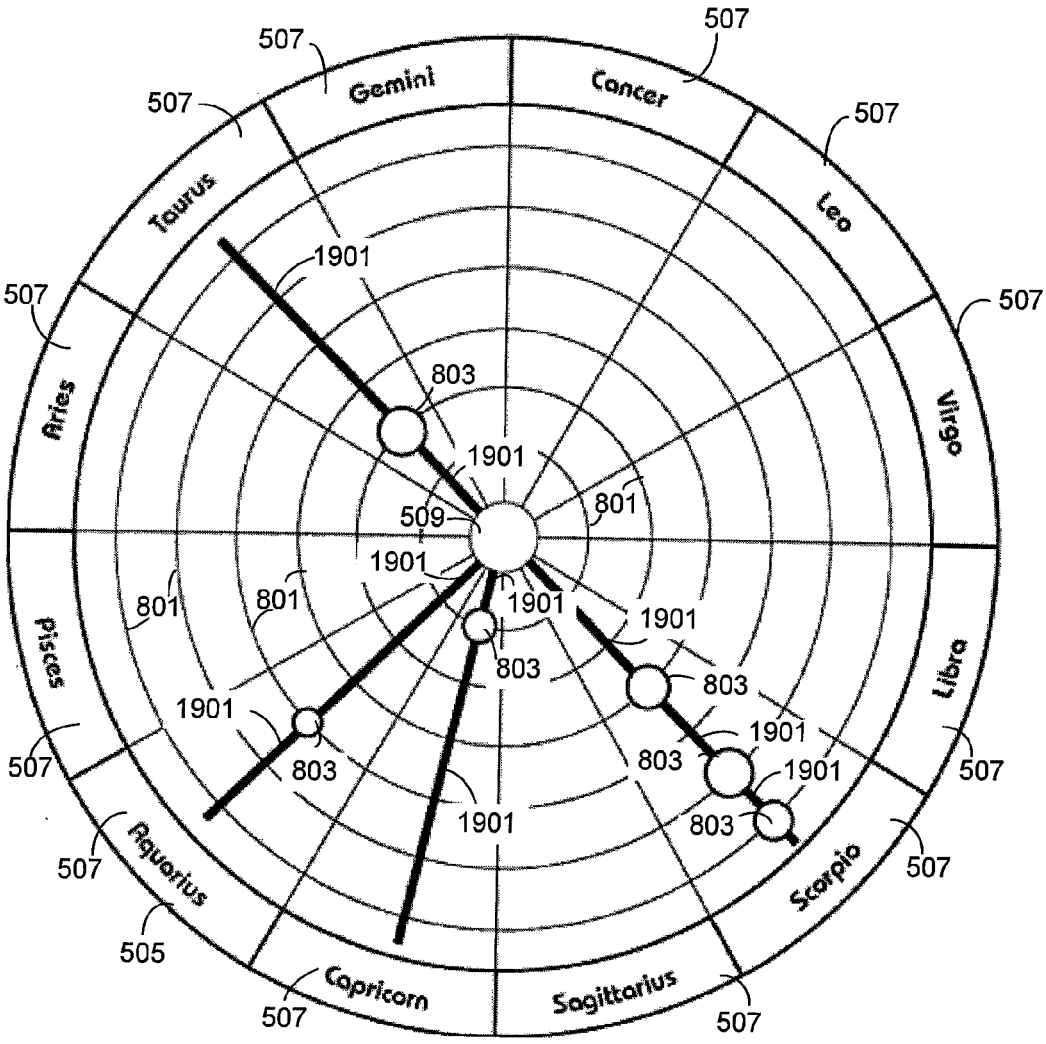
FIG. 19 illustrates a state of the visual interface providing an indication as to winning wager options pertaining to Zodiac Signs.

FIG. 19 illustrates a state of the visual interface 501 identifying winning outcomes, or winning wager options pertaining to Zodiac Signs. Since the Planets 803 are aligned with those of the sections 507 assigned to Capricorn, Aquarius, Taurus, and Scorpio, glowing line segments 1901 extending from the Sun 809, through the corresponding Planets 803, and to those of the sections 507 assigned to Capricorn, Taurus, Aquarius and Scorpio are displayed.

Figure 20:
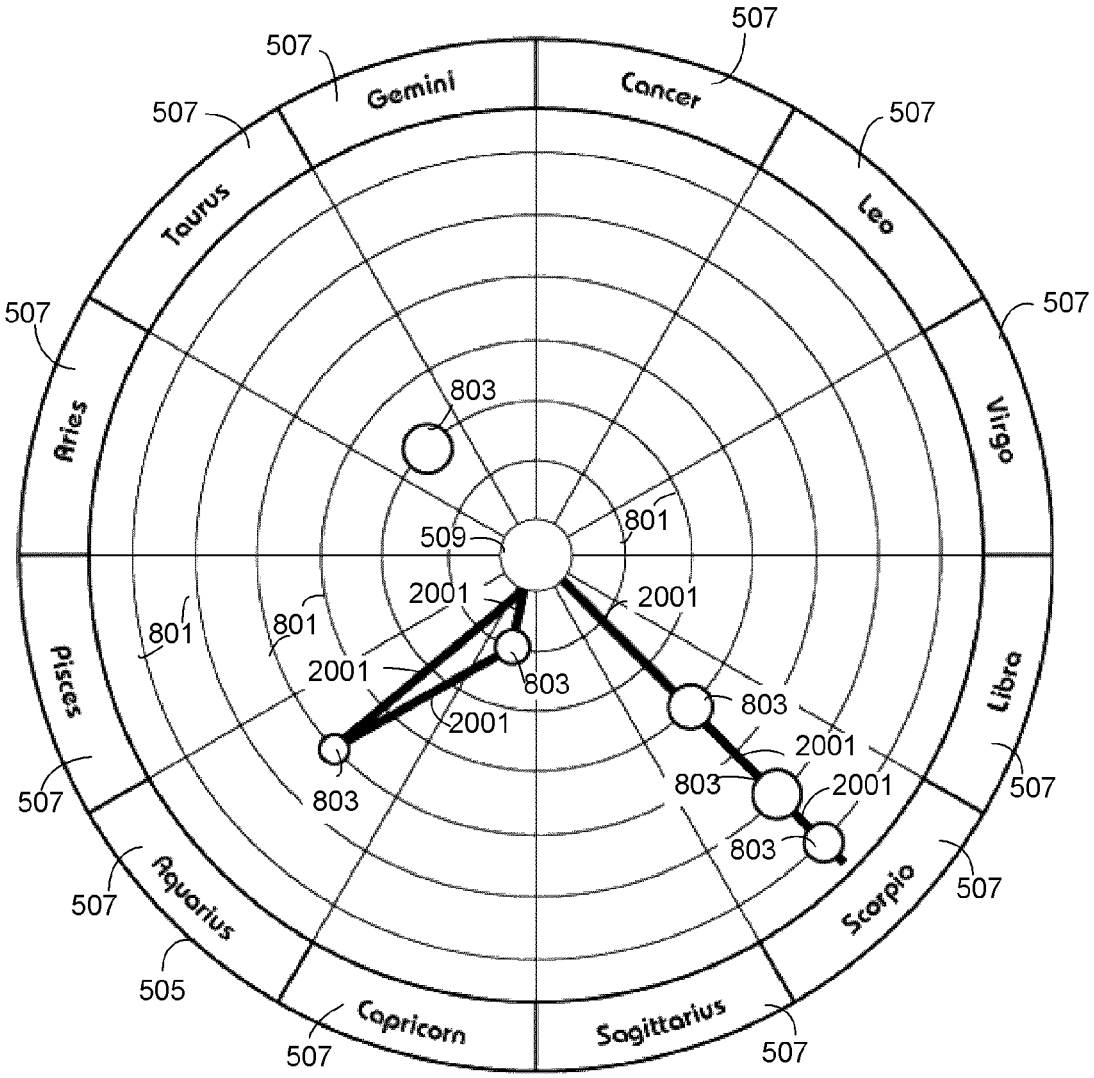
FIG. 20 illustrates a state of the visual interface providing an indication as to winning wager options pertaining to Seasons.

As for FIG. 20, it illustrates a state of the visual interface 501 identifying winning outcomes or wager options pertaining to Seasons. Since two of the Planets 803 are aligned with those of the sections 507 assigned to Signs affiliated with Winter, namely Capricorn and Aquarius, glowing line segments 2001 are displayed as connecting the aforementioned Planets 803 the Sun 809. Furthermore, since three of the Planets 803 are aligned with one of the sections 507 assigned to Scorpio, which is affiliated with Fall, aligned and glowing line segments 2001 connecting the aforementioned ones of the Planets 803 and the Sun 809 are displayed.

Figure 21:
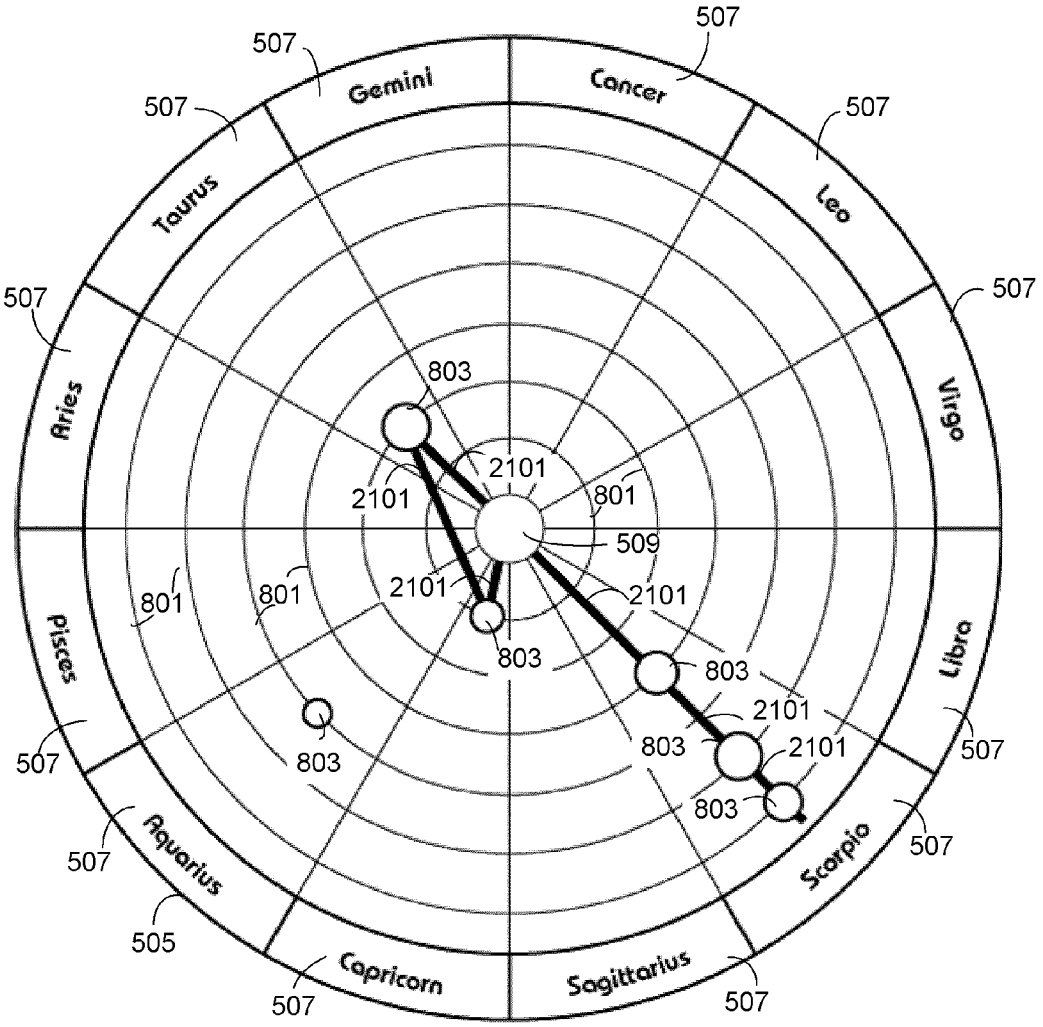
FIG. 21 illustrates a state of the visual interface providing an indication as to winning wager options pertaining to Natural Elements.

Referring now to FIG. 21, there is illustrated a state of the visual interface 501 identifying winning outcomes or wager options pertaining to Natural Elements. Since two of the Planets 803 are aligned with two of the sections 507 assigned to Signs affiliated with Earth, namely Capricorn and Taurus, three glowing line segments 2101 connecting the aforementioned ones of the Planets 803 and the Sun 809 are displayed. Furthermore, since three of the Planets 803 are aligned with one of the sections 507 assigned to Scorpio, a Sign affiliated with Water, aligned and glowing line segments 2101 connecting the aforementioned Planets 803 and the Sun 809 are displayed.

Figure 22:
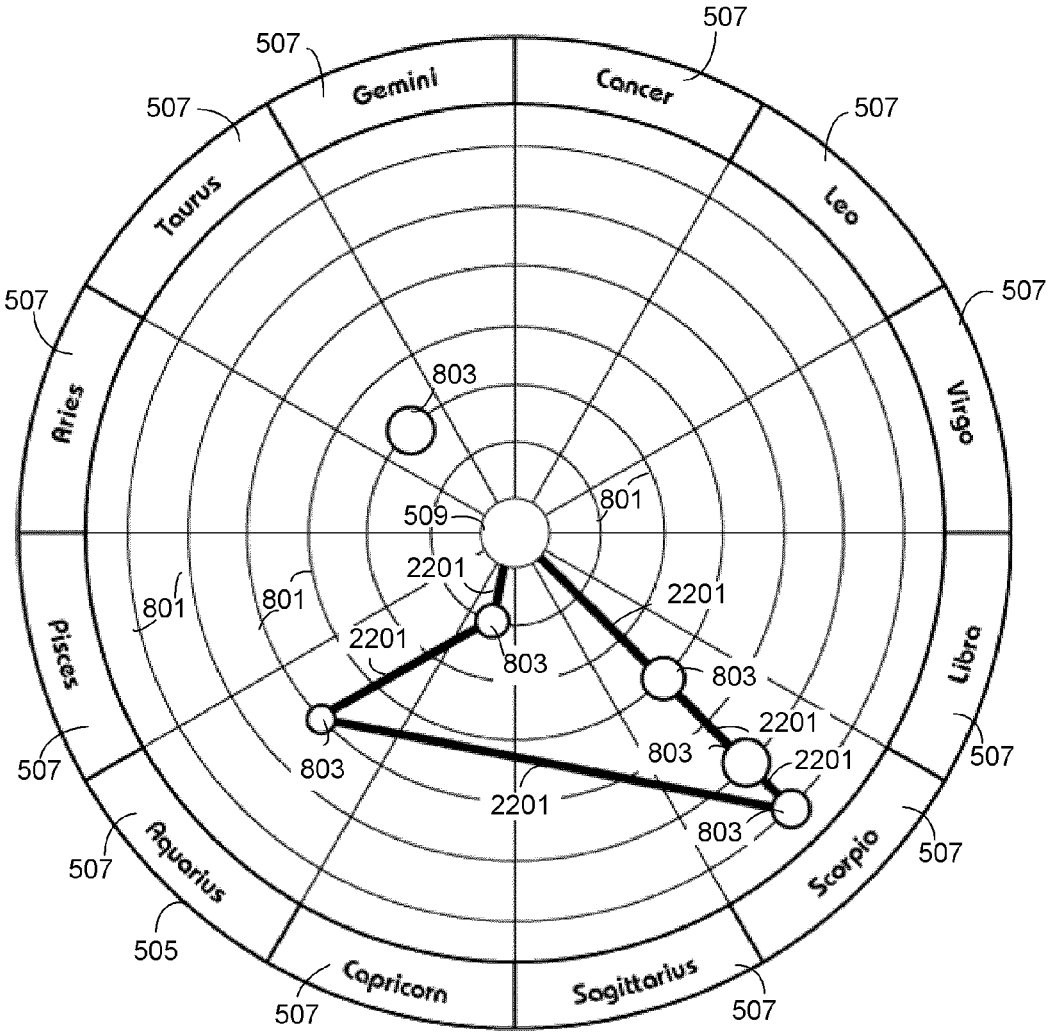
FIG. 22 illustrates a state of the visual interface providing an indication as to winning wager options pertaining to Day and Night.

Referring now to FIG. 22, there is illustrated a state of the visual interface 501 identifying winning outcomes or wager options pertaining to Day and Night. Since five of the Planets 803 are aligned with three of the sections 507 assigned to Signs affiliated with Night, namely two aligned with Capricorn and Aquarius respectively, and three aligned with Scorpio, glowing line segments 2201 connecting the aforementioned ones of the Planets 803 and the Sun 809 are displayed.

Figure 23:
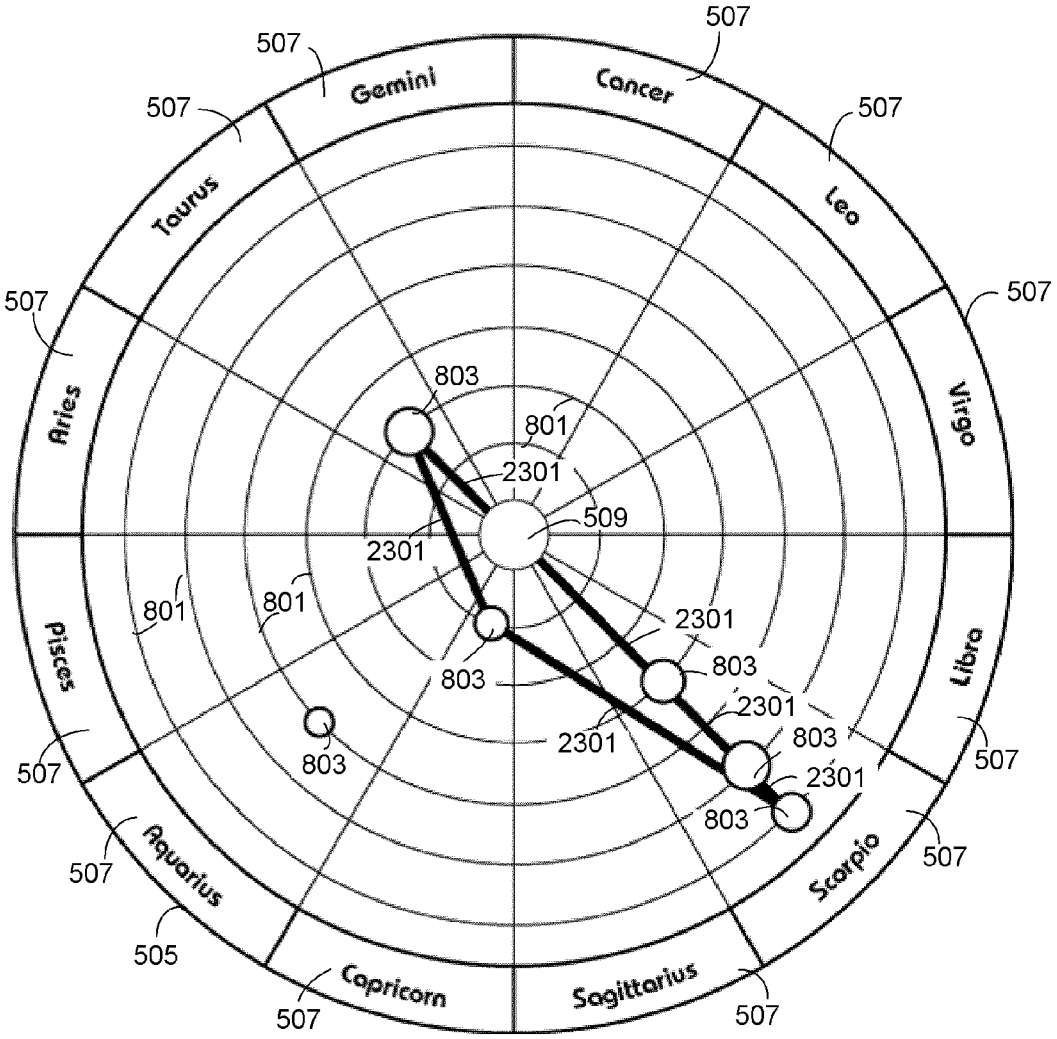
FIG. 23 illustrates a state of the visual interface providing an indication as to winning wager options pertaining to Gender.

Referring now to FIG. 23, there is illustrated a state of the visual interface 501 identifying winning outcomes or wager options pertaining to Gender. Since five of the Planets 803 are aligned with three of the sections 507 assigned to Signs affiliated with Female, namely two aligned with Capricorn and Taurus respectively, and three aligned with Scorpio, glowing line segments 2301 connecting the aforementioned Planets 803 and the Sun 809 are displayed.

Figure 24:
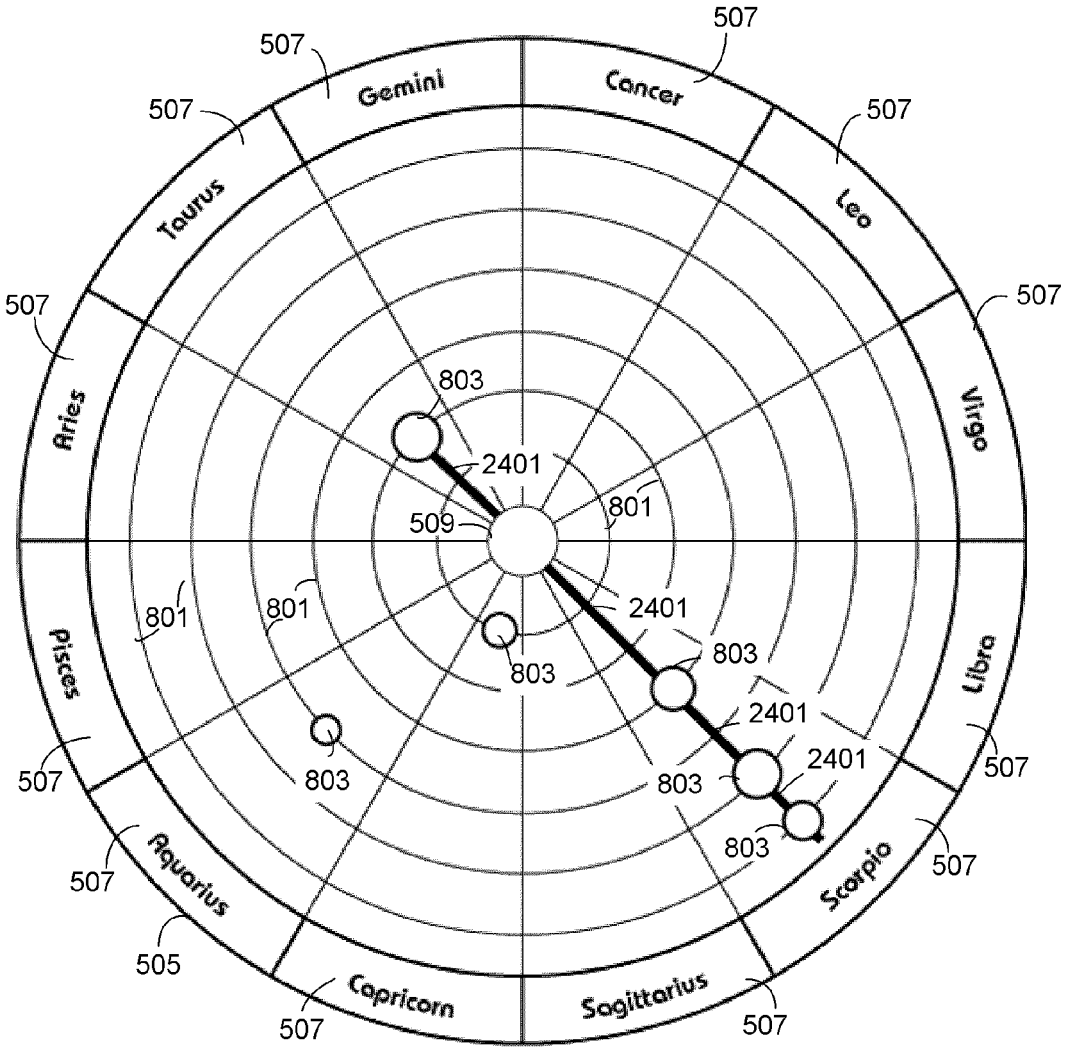
FIG. 24 illustrates a state of the visual interface providing an indication as to winning wager options pertaining to Alignment.

As for FIG. 24, it illustrates a state of the visual interface 501 identifying winning outcomes or wager options pertaining to the Planets 803 or Alignment. Since four of the six Planets 803 are aligned, glowing line segments 2401 connecting the aforementioned ones of the Planets 803 and the Sun 809 are displayed.

Figure 25:
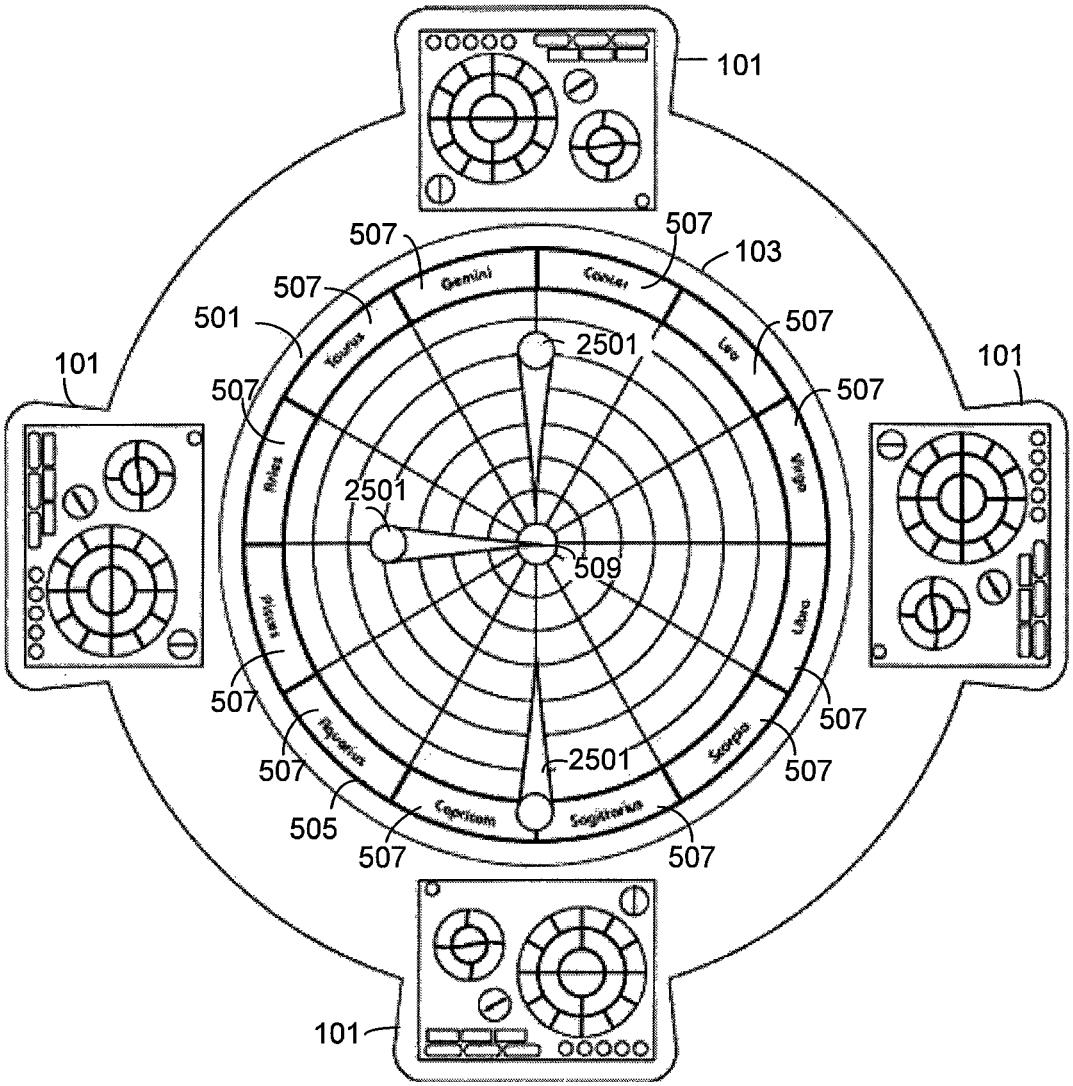
FIG. 25 illustrates a state of the visual interface wherein three light beams are projected from the Sun towards three distinct stations, and each of the beams is indicative of a winning wager placed from a corresponding one of the stations.

Referring now to FIG. 25, once all winning outcomes or wager options have been displayed on the visual interface 501, the orbits 801 and light beams 2501 emanating from the Sun 809 and projected towards those of the stations 101 from which wagers on winning outcomes had been placed are displayed thereon. In the specific case illustrated in FIG. 25, three light beams 2501 emanating from the Sun 809 are projected towards three different ones of the stations 101.

While the game has been described as involving six rotating balls, it may be configured to involve a lesser or greater number of rotating balls, as long as the number of rotating balls is greater than one. Furthermore, while the game has been described as involving twelve constant and six variable reference points, it may be configured to involve different numbers of reference points, as long as the number of constant reference points is lesser than twenty-five. According to one embodiment of the invention, the number of constant reference points or potential outcomes is greater than 4 and smaller than 26. According to another embodiment, the number of constant reference points or potential outcomes is greater than 7 and smaller than 17, and the number of variable reference points or the predetermined number of plays is greater than 3 and smaller than 9.

Furthermore, while the draw has been described as generated and displayed electronically, it may be generated and displayed manually; for instance, a plurality of balls may be propelled manually along their respective tracks, wherein the tracks belong to a series of concentric cylinders. Also, while the game has been described as played on an apparatus comprising four individual stations, it may be played on an apparatus comprising a lesser or greater number of stations, or connected to a network of stations 101 whereby a larger number of players may participate. Also while the individual stations 101 have been described as enabling players to place wagers on a draw generated by and displayed on a communal panel 103, each of these stations 101 may generate and display their own, distinct draws, wherein a player may place wagers on draws generated by and displayed on the communal panel 103 as well as those generated and displayed by the individual station 101.

FIG. 26 is a schematic block diagram of a generic system illustrating how some embodiments operate. The apparatus can be implemented using a standard computer, display screens, and input devices for wager value transactions and wager selection for each series of multiple games. The functional blocks illustrated represent a combination of hardware and software. The game controller 2607 controls the play of a basic game of chance according to its ordinary rules. The chances of winning a single game are much less than 25%. Therefore, to improve the interest of the player playing the game, the multiple game win collector 2611 collects the results of multiple games, and the payout controller 2613 provides a payout with a chance of winning of at least about 25%, even if the payout is only the wager itself. However, the payout controller 2613 also provides a payout of at least 100 times and preferably at least 1000 times the wager when multiple wins arise within the multiple games.

According to the embodiment described above with reference to FIG. 1 to FIG. 31, this system is configured to operate six games of a twelve symbol draw game. The graphics display shows the astrological theme roulette table with an animation of the six balls being determined approximately simultaneously.

The invention claimed is:

1. An apparatus for playing a game of chance, said apparatus comprising a station for receiving a wager on a desired one of a plurality of potential outcomes in said game of chance, a game controller for randomly selecting one of said plurality of outcomes in accordance with rules of said game of chance, and a win controller for comparing said desired outcome to said randomly selected outcome, and for providing a win signal if said desired outcome is the randomly selected outcome, said apparatus characterized in that said apparatus is configured to repeatedly cause said game controller to play said game with said win controller using said desired outcome for a predetermined number of plays of said game, and in that said apparatus further comprises:

a multiple game win collector for counting a total number of said win signals provided during said predetermined number of plays of said game by said game controller; and a multiple game play payout controller for calculating a payout greater than 0 credits if said number of win signals counted during said predetermined number of plays is greater than 0, for calculating said payout as a function of said number of win signals and said wager, and for providing said calculated payout, wherein the odds of said win controller providing at least one of said win signals during said predetermined number of plays is equal to or greater than 25%.

2. The apparatus of claim 1 wherein said predetermined number of plays is greater than 2.

3. The apparatus of claim 2 wherein said multiple game play payout controller increases said payout with each of said win signals provided during said predetermined number of plays.

4. The apparatus of claim 2 wherein said station is for receiving a wager on each of at least two desired ones of said plurality of available outcomes.

5. The apparatus of claim 3 wherein said payout is equal to or greater than 100 times said wager when said total number of said win signals is equal to said predetermined number of plays.

6. The apparatus of claim 5 wherein said payout is equal to or greater than 1000 times said wager when said total number of said win signals is equal to said predetermined number of plays.

7. The apparatus of claim 1 wherein the number of said potential outcomes is greater than 4 and less than 26.

8. The apparatus of claim 7 wherein said number of said potential outcomes is greater than 7 and less than 17, and said predetermined number of plays is greater than 3 and less than 9.

9. The apparatus of claim 1 wherein said odds of said win controller providing at least one of said win signals during said predetermined number of plays is equal to or greater than 30%.

10. The apparatus of claim 1 further comprising an interface controller for causing a display of a symbol that moves along a track before stopping at a randomly selected one of a plurality of potential positions along said track, wherein said game controller comprises a random number generator for randomly selecting said position, each of said potential positions is one of said potential outcomes, and said randomly selected position is said randomly selected outcome.

11. The apparatus of claim 10 wherein said station receives a wager on a pattern of at least three positions, said interface controller causes a simultaneous display of said randomly selected positions during said predetermined number of plays, said win controller determines whether any combination of said randomly selected positions matches said pattern, and said multiple game play payout controller calculates a payout greater than 0 credits if at least one combination of said randomly selected positions matches said pattern.

12. The apparatus of claim 10, wherein said interface controller causes a simultaneous display of a predetermined number of symbols, wherein each of said symbols corresponds to a distinct one of said predetermined plays, each of said symbols is displayed as moving along a distinct track before stopping at a randomly selected one of a plurality of potential positions along said distinct track, and each of said randomly selected positions is said randomly selected outcome of a corresponding one of said plays.

13. The apparatus of claim 11 wherein said pattern is an alignment of at least three positions.

14. The apparatus of claim 11 wherein said station receives a wager on one of a plurality of potential patterns, and said payout controller assigns a greater payout factor to those of said potential patterns having a greater number of said potential positions.

15. The apparatus of claim 14 wherein said station further comprises a matrix of positions for defining said pattern.

16. The apparatus of claim 11 wherein said game controller randomly selects each one of said randomly selected positions from a distinct subset of said plurality of potential positions.

17. The apparatus of claim 11 wherein said payout controller counts a number of combinations of said randomly selected positions that match said pattern, and increases said provided payout with each of said combinations.

18. The apparatus of claim 1 wherein said game controller comprises, either physically or virtually:

a ball; and a roulette wheel having a track and a plurality of indentations, wherein each of said indentations is one of said potential outcomes, and said random selection of one of said potential outcomes is performed by propelling said ball around said track, and identifying the one of said indentations in which said ball lands as said randomly selected outcome.

19. A method of playing a game of chance using a game controller comprising:

receiving a wager of a player on a desired one of a plurality of potential outcomes in said game;

randomly selecting a predetermined number of said potential outcomes in accordance with rules of said game;

the game controller recording said randomly selected outcomes over said predetermined number of plays of said game, and comparing in the game controller said desired outcome and said randomly selected outcomes recorded to generate a comparison result; and the game controller calculating a payout as a function of said comparison result, said payout being greater than 0 credits if said desired outcome is one of said randomly selected outcomes, wherein the odds that said desired outcome is at least one of said randomly selected outcomes is equal to or greater than 25%.

20. The method of claim 19 further comprising providing said calculated payout to said player.

21. The method of claim 20 wherein said payout increases with each random selection of said desired outcome within said predetermined number of selected outcomes.

22. The method of claim 20 wherein said odds that said desired outcome is at least one of said randomly selected outcomes is equal to or greater than 30%.

23. The method of claim 20 further comprising:

receiving a second wager on a second desired one of said plurality of potential outcomes;

comparing said second desired outcome and said randomly selected outcomes; and calculating a payout as a function of said second wager and results of said comparing, said payout being greater than 0 credits if said second desired outcome is one of said randomly selected outcomes, wherein the odds that said second desired outcome is at least one of said randomly selected outcomes is equal to or greater than 25%.

24. The method of claim 19 wherein said number of randomly selected outcomes is greater than 2.

25. The method of claim 24 wherein said payout is equal to or greater than 100 times said wager when each of said randomly selected outcomes is said desired outcome.

26. The method of claim 24 wherein said payout is equal to or greater than 1000 times said wager when each of said randomly selected outcomes is said desired outcome.

27. The method of claim 19 wherein the number of said potential outcomes is greater than 4 and less than 26.

28. The method of claim 27 wherein the number of said potential outcomes is greater than 7 and less than 17, and said number of randomly selected outcomes is greater than 3 and less than 9.

29. The method of claim 19 further comprising displaying a symbol that moves along a track before stopping at a randomly selected one of a plurality of potential positions along said track, wherein each of said potential positions is one of said potential outcomes, and said randomly selected outcome is said randomly selected position.

30. The method of claim 19 wherein said randomly selecting one of said plurality of outcomes comprises propelling a ball along a track of a roulette wheel, and identifying the one of a plurality of roulette wheel indentations in which said ball lands as said randomly selected outcome, wherein each of said indentations is one of said outcomes.

31. An apparatus for playing a game of chance comprising:

a station for receiving a wager on some desired ones of a plurality of potential patterns of at least three positions;

a game controller for randomly selecting at least three of a plurality of potential positions; and a payout controller for providing a payout as a function of said wager if any combination of said randomly selected positions matches any one of said desired patterns.

32. The apparatus of claim 31 wherein the number of said potential patterns is greater than 2.

33. The apparatus of claim 31 wherein said payout controller assigns a greater payout factor to each of said potential patterns than to those of said potential patterns of fewer said potential positions.

34. The apparatus of claim 31 wherein at least one of said potential patterns is an alignment of at least three of said potential positions.

35. The apparatus of claim 31 wherein said payout controller counts a number of combinations of said randomly selected positions that match each one of said desired patterns, and increases said provided payout with each of said combinations.

36. The apparatus of claim 31 wherein said station further comprises a matrix of positions for defining at least a custom one of said desired patterns.

37. The apparatus of claim 31 wherein said station is for selecting a desired one of a plurality of potential positions and for placing a wager on said desired position, and said payout controller is for providing a payout as a function of said wager placed on said desired position if said desired position is at least one of said randomly selected positions.

38. The apparatus of claim 31 wherein said game controller comprises a random number generator for said random selection.

39. The apparatus of claim 31 wherein said game controller randomly selects each one of said potential positions from a distinct subset of said plurality of potential positions.

40. The apparatus of claim 31 wherein said game controller comprises:

a ball; and a roulette wheel having a track and a plurality of indentations, wherein each of said indentations is one of said potential positions, and said random selection of one of said potential positions is performed by propelling said ball around said track, and identifying the one of said indentations in which said ball lands as said randomly selected position.

41. A method of playing a game of chance using a game controller comprising:

selecting some desired ones of a plurality of potential patterns of at least three positions;

placing a wager on said desired patterns;

the game controller randomly selecting in a game controller at least three of a plurality of potential positions; and the game controller determining in a game controller a payout as a function of said wager if any combination of said randomly selected positions matches any of said desired patterns.

42. The method of claim 41 wherein the number of said potential patterns is greater than 2.

43. The method of claim 42 wherein each of said potential patterns is assigned a greater payout factor than those of said potential patterns of fewer said potential positions.

44. The method of claim 41 wherein at least one of said potential patterns is an alignment of at least three of said potential positions.

45. The method of claim 41 wherein said providing a payout comprises calculating a number of combinations of said randomly selected positions that match each one of said desired patterns, and increasing said payout with each of said combinations.

46. The method of claim 41 wherein said selecting some desired patterns comprises defining at least a custom one of said desired patterns.

47. The method of claim 41 wherein each of said potential positions is randomly selected from a distinct subset of said potential positions.

48. The method of claim 41 further comprising:

selecting a desired one of a plurality of potential positions placing a wager on said desired position; and providing a payout as a function of said wager placed on said desired position if said desired position is at least one of said randomly selected positions.

49. An apparatus for playing a game of chance comprising:

a station for receiving a first wager on a desired one of a plurality of potential positions, and for receiving a second wager on a desired one of a plurality of potential patterns of at least three positions;

a game controller for randomly selecting at least three of said plurality of potential positions; and a payout controller for providing a payout as a function of said first wager if said desired position is one of the randomly selected positions, and for providing a payout as a function of said second wager if any combination of said randomly selected positions matches said desired pattern.

50. The apparatus of claim 49 wherein the number of said potential patterns is greater than 2.

51. The apparatus of claim 50 wherein said payout controller assigns a greater payout factor to each of said potential patterns than to those of said potential patterns of fewer said potential positions.

52. The apparatus of claim 51 wherein said station further comprises a matrix of positions for defining said desired pattern.

53. The apparatus of claim 49 wherein at least one of said potential patterns is an alignment of at least three of said potential positions.

54. The apparatus of claim 49 wherein said payout controller counts a number of combinations of said randomly selected positions that match said desired pattern, and increases said provided payout with each of said combinations.

55. The apparatus of claim 49 wherein said game controller comprises a random number generator for said random selection.

56. The apparatus of claim 49 wherein said game controller randomly selects each one of said potential positions from a distinct subset of said plurality of potential positions.

57. The apparatus of claim 49 wherein said game controller comprises:

a ball; and a roulette wheel having a track and a plurality of indentations, wherein each of said indentations is one of said potential positions, and said random selection of one of said potential positions is performed by propelling said ball around said track, and identifying the one of said indentations in which said ball lands as said randomly selected position.

58. An apparatus for placing wagers on potential outcomes of a game of chance, said apparatus comprising:

a station for receiving a first wager on a desired one of said potential outcomes, and for receiving a second wager on a desired group of at least two of said potential outcomes;

a first interface controller for causing a display of said potential outcomes along a first closed shape, and for causing a display of a visual indicator of said first wager over said desired outcome; and a second interface controller for causing a display of groups of at least two of said potential outcomes along a second closed shape, and for displaying a visual indicator of said second wager over said desired group, wherein those of said displayed outcomes belonging to a same one of said displayed groups are contiguous, and each of said displayed outcomes is aligned with those of said displayed groups to which it belongs.

59. The apparatus of claim 58 wherein said second interface controller causes a display of said groups within boundaries defined by said first closed shape.

60. The apparatus of claim 58 wherein said station is for receiving a third wager on a second desired group of at least three of said potential outcomes, said apparatus further comprising a third interface controller for causing a display of groups of at least three of said potential outcomes along a third closed shape, and for displaying a visual indicator of said third wager over said second desired group.

61. The apparatus of claim 60 wherein said closed shapes are circular and have a same center.

62. In a multiplayer game of chance in which players can place their wagers at any time over the course of a wager phase, an apparatus for identifying in real-time, and to said players, one of two stations from which each of said wagers is placed, said apparatus comprising:

a first one of said stations for receiving some of said player wagers and for providing a wager signal to a wager sequencer upon receiving each one of said first station player wagers, wherein said first station wager signals comprise the identity of said first station;

a second one of said stations for receiving some of said player wagers and for providing a wager signal to said wager sequencer upon receiving each one of said second station player wagers, wherein said second station wager signals comprise the identity of said second station;

said wager sequencer for providing said first and said second station wager signals to an interface controller in the order in which they were provided by said first and said second station; and said interface controller for causing a display of a visual indicator of one of said first and said second station that received each of said wagers upon being provided each of said first and said second station wager signals.

63. The apparatus of claim 62 further comprising a communal panel surrounded by said stations, wherein said interface controller causes said visual indicator to be displayed on said panel.

64. The apparatus of claim 63 wherein said interface controller causes said display of said visual indicator to move from said station to be identified to a center of said communal panel.

65. The apparatus of claim 62 wherein said interface controller causes a play of a sound indicator identifying to said players said station to be identified.

66. The apparatus of claim 65 further comprising a payout controller for identifying a winning one of said first station wagers, for providing a payout signal comprising said first station identity to said interface controller upon identifying said winning first station wager, for identifying a winning one of said second station wagers, and for providing a payout signal comprising said second station identity to said interface controller, wherein said interface controller causes a display of a second visual indicator of one of said first and said second station that received each of said winning wagers upon being provided each of said first and said second station payout signal.

67. The apparatus of claim 66 wherein said payout signal comprises a payout, and said second visual indicator identifies said payout.

68. The apparatus of claim 66 wherein said interface controller displays said second visual indicator for no more than 5 seconds.

69. The apparatus of claim 62 wherein said wager signal comprises an amount wagered, and said visual indicator identifies said amount.

70. The apparatus of claim 62 wherein said interface controller displays said visual indicator for no more than 5 seconds.

71. In a game of chance that offers a plurality of wager options, an apparatus for displaying winning ones of said options after an outcome of said game has been determined, said apparatus comprising:

a winning wager options controller for identifying those of said options that are met by said determined outcome, namely said winning options;

a winning wager options sequencer for dividing said winning options into at least two groups of winning options, and for providing each of said groups to an interface controller individually and at predetermined intervals of time; and said interface controller for causing an individual display of a most recently provided one of said groups.

72. The apparatus of claim 71 wherein at least one of said groups comprises at least two of said winning options.

73. The apparatus of claim 71 wherein said interface controller causes a simultaneous display of all wager options, and causes a display of a visual indicator over those of said displayed options belonging to said displayed group.

74. The apparatus of claim 71 wherein said game of chance is a roulette-type game, said interface controller causes a display of a plurality of symbols of said game, each of said displayed symbols is one of said plurality of wager options, and said interface controller causes a display of a visual indicator over those of said displayed symbols belonging to said displayed group.

75. The apparatus of claim 71 wherein each of said groups comprises no more than one of said winning options.

76. The apparatus of claim 71 further comprising a payout controller for identifying those of said stations that have received wagers on those of said winning options belonging to said displayed group, wherein said interface controller causes a display of a visual indicator of said winning stations.

* * * * *